US011487214B2

(12) United States Patent
Higuchi et al.

(10) Patent No.: US 11,487,214 B2
(45) Date of Patent: Nov. 1, 2022

(54) CHARGING ROLLER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Nao Higuchi, Shizuoka (JP); Mototeru Goto, Shizuoka (JP); Masaki Tsunoda, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/514,160

(22) Filed: Oct. 29, 2021

(65) Prior Publication Data

US 2022/0146958 A1 May 12, 2022

(30) Foreign Application Priority Data

Nov. 9, 2020 (JP) ..... JP2020-186694
Sep. 16, 2021 (JP) ..... JP2021-150875

(51) Int. Cl.
*G03G 15/02* (2006.01)
*G03G 21/18* (2006.01)

(52) U.S. Cl.
CPC ..... *G03G 15/0233* (2013.01); *G03G 21/1814* (2013.01); *G03G 2215/0861* (2013.01)

(58) Field of Classification Search
CPC ..... G03G 15/0233; G03G 21/1814; G03G 2215/0861
See application file for complete search history.

(56) References Cited

U.S. PATENT DOCUMENTS 6,697,587 B2 2/2004 Harada et al.
9,645,517 B2 5/2017 Sato et al.
9,733,596 B1 8/2017 Furukawa et al.
(Continued)

FOREIGN PATENT DOCUMENTS

EP 1 901 131 A1 3/2008
JP 2002-3651 A 1/2002
(Continued)

OTHER PUBLICATIONS

Extended European Search Report in European Application No. 21206609.6 (dated Mar. 2022).
(Continued)

*Primary Examiner* — Sandra Brase
(74) *Attorney, Agent, or Firm* — Venable LLP

(57) ABSTRACT

A charging roller comprising an electroconductive mandrel and an electroconductive layer as a surface layer, the electroconductive layer including a matrix containing a cross-linked product of a first rubber and domains dispersed in the matrix, each of the domains containing a cross-linked product of a second rubber and an electroconductive particle, the domains each having a volume resistivity lower than a volume resistivity of the matrix, and when sampling a cubic sample of the electroconductive layer having a side of 20.0 μm from a region from an outer surface of the electroconductive layer to a depth of 20.0 μm, 50 number % or more of all the domains in the cubic sample satisfy a specific condition.

7 Claims, 7 Drawing Sheets

(56) References Cited

U.S. PATENT DOCUMENTS

| | | | | |
|---|---|---|---|---|
| 10,558,136 | B2 | 2/2020 | Furukawa et al. | |
| 10,845,724 | B2 | 11/2020 | Kikuchi et al. | |
| 11,112,748 | B2 | 9/2021 | Kamada et al. | |
| 11,169,454 | B2 | 11/2021 | Nishioka et al. | |
| 11,175,602 | B2 | 11/2021 | Nishioka et al. | |
| 2017/0102633 | A1* | 4/2017 | Yoshidome ..... | G03G 15/0233 |
| 2020/0310264 | A1 | 10/2020 | Kurachi et al. | |
| 2020/0310265 | A1 | 10/2020 | Nishioka et al. | |
| 2020/0310266 | A1* | 10/2020 | Kikuchi ..... | G03G 15/0233 |
| 2021/0026295 | A1 | 1/2021 | Yamada et al. | |
| 2021/0033996 | A1 | 2/2021 | Kikuchi et al. | |
| 2021/0048759 | A1 | 2/2021 | Hino et al. | |

FOREIGN PATENT DOCUMENTS

| | | | |
|---|---|---|---|
| JP | 2005-092134 | A | 4/2005 |
| JP | 2005-115204 | A | 4/2005 |
| JP | 2013-174808 | A | 9/2013 |
| JP | 2015-084010 | A | 4/2015 |
| JP | 2017-181604 | A | 10/2017 |
| JP | 2020-166210 | A | 10/2020 |
| WO | 2021/075371 | A1 | 4/2021 |
| WO | 2021/075430 | A1 | 4/2021 |
| WO | 2021/075441 | A1 | 4/2021 |
| WO | 2021/075442 | A1 | 4/2021 |
| WO | 2021/075530 | A1 | 4/2021 |
| WO | 2021/075532 | A1 | 4/2021 |

OTHER PUBLICATIONS

Takashi Sanada et al., "Morphology Control of Polymer Alloy by Reactive Processing and Morphology Evolution," Sumitomo Chemical Co., Ltd., 2003-II, pp. 42-54 (2003).

International Search Report and Written Opinion in International Application No. PCT/JP2021/040929 (dated Dec. 2021).

* cited by examiner

CHARGING ROLLER, PROCESS CARTRIDGE, AND ELECTROPHOTOGRAPHIC IMAGE FORMING APPARATUS

BACKGROUND

The present disclosure is directed to a charging roller, a process cartridge, and an electrophotographic image forming apparatus.

DESCRIPTION OF THE RELATED ART

In an electrophotographic image forming apparatus adopting a contact charging system, a charging roller for charging the surface of an electrophotographic photosensitive member is arranged so as to be brought into abutment with the electrophotographic photosensitive member.

The charging roller includes an electroconductive base and an electroconductive layer on the base. In addition, in the electrophotographic image forming apparatus, a voltage is applied between the electroconductive base of the charging roller and the electrophotographic photosensitive member, and is discharged from the surface of the electroconductive layer of the charging roller facing the electrophotographic photosensitive member (hereinafter also referred to as "outer surface") toward the electrophotographic photosensitive member. Thus, the surface of the electrophotographic photosensitive member facing the charging roller is charged.

In Japanese Patent Application Laid-Open No. 2002-3651, there is a disclosure of a charging roller including an elastic layer including: a polymer continuous phase formed of an ionic electroconductive rubber material; and a polymer particle phase formed of an electronic electroconductive rubber material.

According to an investigation by the inventors, when the charging roller according to Japanese Patent Application Laid-Open No. 2002-3651 is used in the formation of an electrophotographic image under a low-temperature and low-humidity environment having, for example, a temperature of 15° C. and a relative humidity of 10%, a streak extending in a direction perpendicular to the circumferential direction of the charging roller (hereinafter also referred to as "horizontal streak") has been formed in the electrophotographic image in some cases.

SUMMARY

At least one aspect of the present disclosure is directed to providing a charging roller conducive to stable formation of high-quality electrophotographic images under various environments. In addition, another aspect of the present disclosure is directed to providing a process cartridge conducive to stable provision of high-quality electrophotographic images. Further, another aspect of the present disclosure is directed to providing an electrophotographic image forming apparatus capable of stably forming a high-quality electrophotographic image. According to one aspect of the present disclosure, there is provided a charging roller including: an electroconductive mandrel; and an electroconductive layer as a surface layer, the electroconductive layer including a matrix containing a cross-linked product of a first rubber and domains dispersed in the matrix, each of the domains containing a cross-linked product of a second rubber and an electroconductive particle, the domains each having a volume resistivity lower than a volume resistivity of the matrix, wherein when sampling a cubic sample of the electroconductive layer having a side of 20.0 μm from a region from an outer surface of the electroconductive layer to a depth of 20.0 μm, 50 number % or more of all the domains in the cubic sample satisfy the following condition:

<Condition>

Assuming that a domain to be judged in the cubic sample is enveloped by an enveloping cuboid, the enveloping cuboid having two surfaces each of which is perpendicular to a line segment L, the line segment L passing through at least one arbitrary point in the domain to be judged and being perpendicular to a surface of the mandrel, "x" is longer than "y" and "z", where "x" is a length of the enveloping cuboid in an X-axis direction, "y" is a length thereof in a Y-axis direction, and "z" is a length thereof in a Z-axis direction, and a line segment S that is perpendicular to the line segment L and is parallel to an X-axis is able to be drawn.

According to another aspect of the present disclosure, there is provided a process cartridge detachably attachable to a main body of an electrophotographic image forming apparatus, the process cartridge comprising: an electrophotographic photosensitive member; and the afore mentioned charging roller arranged so as to be capable of charging the electrophotographic photosensitive member.

According to further aspect of the present disclosure, there is provided an electrophotographic image forming apparatus comprising: an electrophotographic photosensitive member; and the afore mentioned charging roller arranged so as to be capable of charging the electrophotographic photosensitive member.

Further features of the present disclosure will become apparent from the following description of exemplary embodiments with reference to the attached drawings.

DESCRIPTION OF THE EMBODIMENTS

Figure 1:
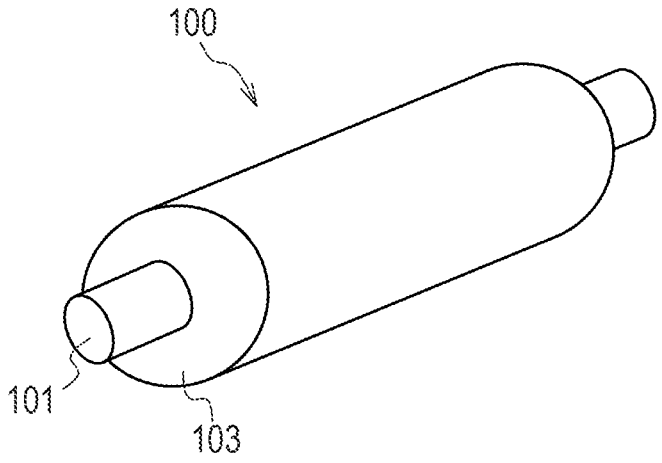
FIG. 1 is a perspective view of a charging roller according to one aspect of the present disclosure.

The reason why when an electrophotographic image is formed with the charging member according to Japanese Patent Application Laid-Open No. 2002-3651 under the low-temperature and low-humidity environment, a horizontal streak occurs in the electrophotographic image is assumed to be as described below.

The charging member rotates under the state of being brought into abutment with an electrophotographic photosensitive member, and hence charge may be generated on the surface of the portion of the charging member brought into abutment with the electrophotographic photosensitive member (hereinafter also referred to as "nip portion") by the friction of the charging member with the electrophotographic photosensitive member. In order for the surface of the charging member to exhibit a function of discharging the charge to the electrophotographic photosensitive member, predetermined electroconductivity is imparted to the surface by an ionic electroconductive agent or an electronic electroconductive agent. Accordingly, the triboelectric charge generated on the surface of the charging member by the friction with the electrophotographic photosensitive member diffuses but the directivity of the diffusion is not controlled, and hence a portion where the charge is locally high may be present in the region of the electroconductive layer of the charging member ranging from the surface of the nip portion of the electroconductive layer to the mandrel of the charging member. Then, the portion where the charge is locally high causes the unevenness of the discharge from the charging member. Then, such discharge unevenness may cause potential unevenness on the surface of the electrophotographic photosensitive member. In view of the foregoing, with a view to preventing the occurrence of a portion where the charge locally stays in the elastic layer of the charging member, the inventors have made investigations on the configuration of the charging member that can control the direction in which the triboelectric charge generated on the surface of the charging member diffuses. As a result, the inventors have found that the following charging member can control the direction in which the triboelectric charge generated on its surface diffuses.

That is, a charging member according to one aspect of the present disclosure includes an electroconductive mandrel and an electroconductive layer serving as a surface layer. The electroconductive layer includes a matrix containing a first rubber and domains dispersed in the matrix. Each of the domains contains a cross-linked product of a second rubber and an electroconductive particle. In addition, the domains each have a volume resistivity lower than a volume resistivity of the matrix.

Further, when sampling a cubic sample of the electroconductive layer having a side of 20.0 μm from a region from an outer surface of the electroconductive layer to a depth of 20.0 μm, 50 number % or more of all the domains in the cubic sample satisfy the following condition.

<Condition>

Assuming that a domain to be judged in the cubic sample is enveloped by an enveloping cuboid, the enveloping cuboid having two surfaces each of which is perpendicular to a line segment L, the line segment L passing through at least one arbitrary point in the domain to be judged and being perpendicular to a surface of the mandrel, "x" is longer than "y" and "z", where "x" is a length of the enveloping cuboid in an X-axis direction, "y" is a length thereof in a Y-axis direction, and "z" is a length thereof in a Z-axis direction, and a line segment S that is perpendicular to the line segment L and is parallel to an X-axis can be drawn.

The charging member according to one aspect of the present disclosure is described below with reference to the drawings.

Figure 2A:
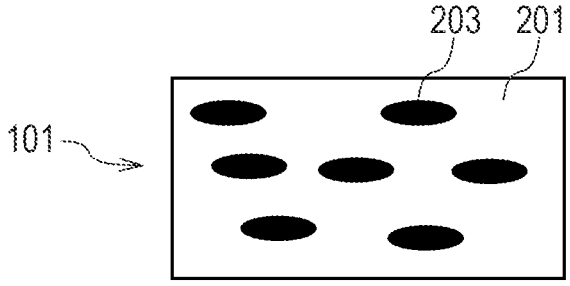
FIG. 2A is a schematic view of a section of an electroconductive layer according to one aspect of the present disclosure in its longitudinal direction.
Figure 2B:
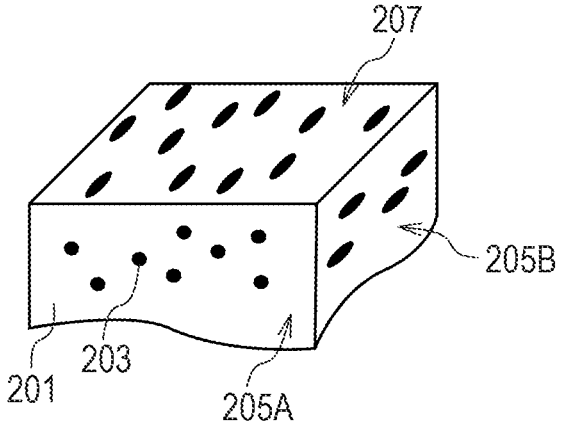
FIG. 2B is a schematic view for illustrating the states of domains present in a surface region from the outer surface of the electroconductive layer according to one aspect of the present disclosure to a depth of 20 μm.

FIG. 1 is a perspective view of a charging roller 100 according to one aspect of the present disclosure. The charging roller 100 includes a mandrel 101 having an electroconductive outer surface and an electroconductive layer 103 coating the outer peripheral surface of the mandrel 101. FIG. 2A and FIG. 2B are explanatory views of the configuration of the electroconductive layer 103 of the charging roller 100, and FIG. 2A is a schematic view of a section of the electroconductive layer 103 in a direction perpendicular to the circumferential direction of the charging roller 100 (hereinafter also referred to as "longitudinal direction"). The electroconductive layer 103 includes a matrix 201 containing a first rubber and domains 203 dispersed in the matrix. FIG. 2B is a schematic view for illustrating the states of the domains 203 present in a surface region from the outer surface of the electroconductive layer to a depth of 20 μm. In FIG. 2B, a section of the electroconductive layer 103 in the circumferential direction of the charging roller is represented by reference symbol 205A, and a section of the electroconductive layer 103 in the longitudinal direction is represented by reference symbol 205B. In addition, the outer surface of the electroconductive layer is represented by reference symbol 207, and the outer surface 207 of the electroconductive layer is the outer surface of the charging roller, that is, a surface serving as a surface facing an electrophotographic photosensitive member. In addition, each of the domains 203 contains an electroconductive particle, such as carbon black (not shown).

Figure 3:
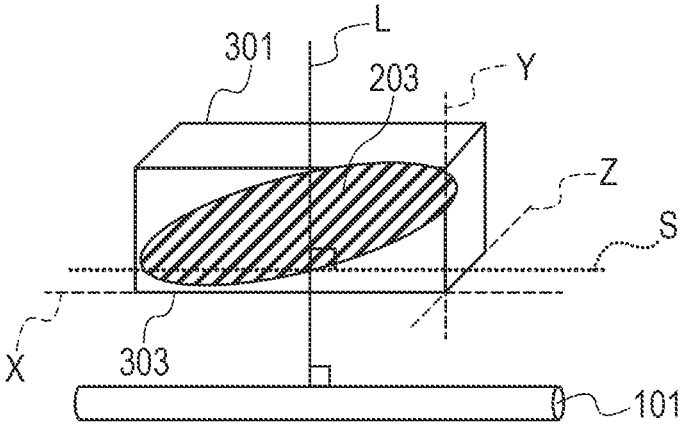
FIG. 3 is an explanatory view of one domain in the electroconductive layer according to one aspect of the present disclosure.

Next, the domain 203 satisfying the above-mentioned condition is described with reference to FIG. 3. In FIG. 3, the scales of the mandrel 101 and the domain 203 are not coordinated to each other. A cuboid (hereinafter also referred to as "enveloping cuboid") 301 enveloping the domain 203 is demarcated. The enveloping cuboid 301 is defined as a cuboid all the six surfaces of which are in contact with the domain 203. In addition, when the line segment L that passes through one arbitrary point in the domain 203 and is perpendicular to the surface of the mandrel 101 is drawn, two surfaces out of the six surfaces for forming the enveloping cuboid 301 are perpendicular to the line segment L. In addition, when the length of the enveloping cuboid 301 in the X-axis direction is represented by "x", the length thereof in the Y-axis direction is represented by "y", and the length thereof in the Z-axis direction is represented by "z", the "x" is longer than the "y" and the "z". In other words, the longest side 303 of the enveloping cuboid 301 is set to the X-axis. At this time, in the domain 203 according to the present disclosure, the line segment S that is parallel to the X-axis and is perpendicular to the line segment L can be drawn. That is, it can be said that the domain 203 satisfying the condition is present in the electroconductive layer under the state of extending in, specifically, for example, the non-depth direction of the electroconductive layer, such as the longitudinal direction.

In addition, the volume resistivity of each of the domains 203 is lower than the volume resistivity of the matrix 201. Accordingly, the domains 203 containing the electroconductive particle are mainly responsible for charge transfer in the electroconductive layer. Accordingly, in the electroconductive layer including a certain amount of the domains each satisfying such condition as described above, the volume resistivity of each of the domains 203 is lower than the volume resistivity of the matrix 201, and hence even when triboelectric charge is generated on the surface of the nip portion of the charging roller, the charge can be diffused in the directions in which the domains 203 extend through the domains 203. That is, the transfer direction of the triboelectric charge in the electroconductive layer can be controlled.

Figure 4:
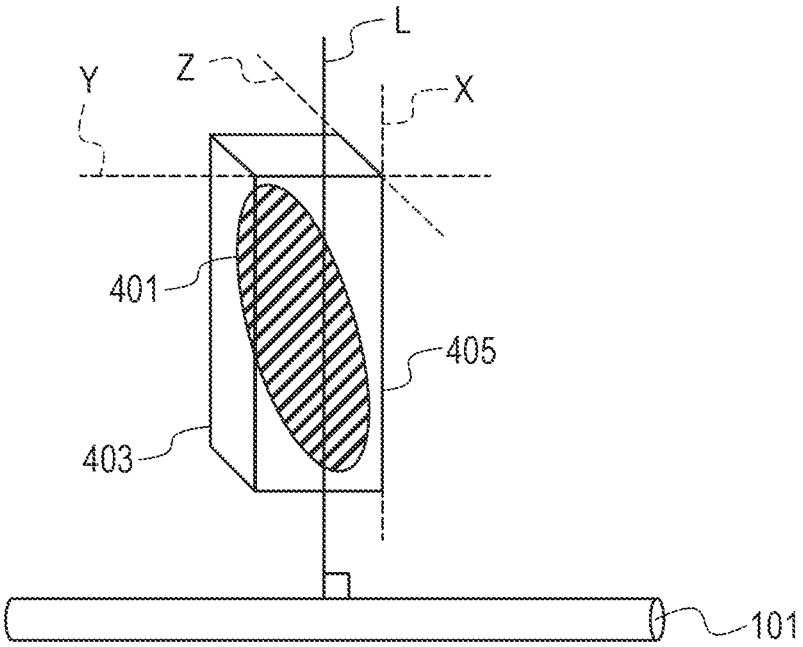
FIG. 4 is an explanatory view of a domain that does not satisfy a condition according to the present disclosure.

Meanwhile, FIG. 4 is an illustration of an example of a domain that does not satisfy the condition. When the longest side 405 of the enveloping cuboid 403 of a domain 401 is set to an X-axis in FIG. 4, the X-axis is perpendicular to the surface of the mandrel 101. Accordingly, when the line segment L that passes through an arbitrary point in the domain 401 and is perpendicular to the surface of the mandrel 101 is drawn, the line segment S that is perpendicular to the line segment L and is parallel to the X-axis cannot be drawn. Such domain 401 extends from the outer surface of the electroconductive layer toward the mandrel. In this case, the triboelectric charge generated on the surface of the nip portion remains in a region between the surface of the nip portion and the mandrel, and hence may affect the discharge performance of the charging roller.

<Inferior Angle Formed by Line Segment P and Line Segment Q>

The enveloping cuboid includes a first YZ surface and a second YZ surface facing each other, the surfaces each including the Y-axis and the Z-axis. The longest line segment out of line segments each connecting the portion of the first YZ surface in contact with the domain and the portion of the second YZ surface in contact with the domain is defined as a line segment P. When a line segment Q having a same starting point as a starting point of the line segment P in the first or second YZ surface and being perpendicular to the surface of the mandrel is drawn, an inferior angle formed by the line segment P and the line segment Q is defined as an inferior angle θ, a mode value of the inferior angle θ of each of all the domains in the cubic sample preferably falls within 60° or more and 90° or less. In order for charge generated by triboelectric charging between the electrophotographic photosensitive member and the charging roller to immediately transfer from the nip position of the charging roller to the non-nip position thereof, it is important that the direction in which the domain extends be not oriented toward the depth direction of the electroconductive layer. Accordingly, herein, the extent to which the direction in which the domain extends is oriented toward the depth direction is specified.

Figure 5:
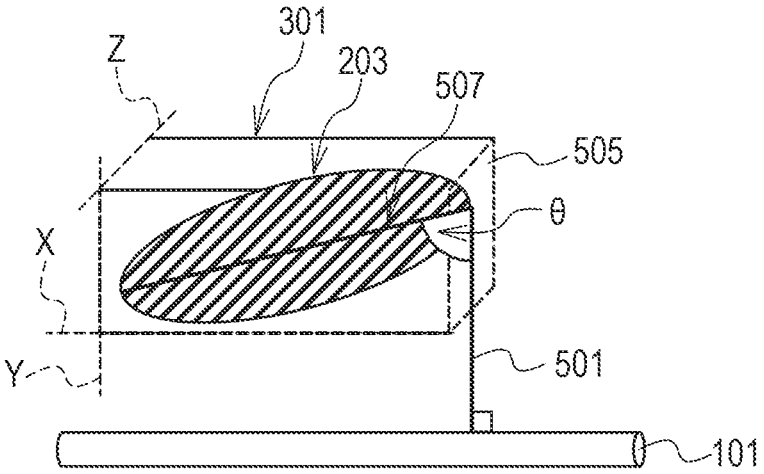
FIG. 5 is an explanatory view of an angle representing the direction in which the domain according to the present disclosure extends.

FIG. 5 is an explanatory view of an inferior angle θ representing the direction in which the domain 203 according to the present disclosure extends. When the longest side of the enveloping cuboid 301 is defined as the X-axis, the longest line segment 507 out of line segments each connecting the point of contact of a first YZ surface 505 in the enveloping cuboid with the domain 203 and a point of contact in a second YZ surface in the enveloping cuboid facing the first YZ surface with the domain 203 is a line segment representing the maximum length of the domain. In addition, when a line segment 501 that passes through the point of contact of the line segment 507 with the first YZ surface and is perpendicular to the mandrel 101 is drawn, an inferior angle formed by the line segment 507 and the line segment 501 is represented by θ. When the inferior angle θ is 90°, it can be said that the domain 203 extends in the tangential direction of the outer surface of the electroconductive layer 103. As the inferior angle θ reduces from 90°, the domain 203 extends in the thickness direction of the electroconductive layer to a larger extent. Accordingly, the inferior angle θ is preferably set to 60° or more and 90° or less for causing the triboelectric charge generated on the surface of the charging roller to escape from the nip portion to suppress the occurrence of the unevenness of discharge from the charging roller.

<Length "x" of Enveloping Cuboid in X-Axis Direction>

The arithmetic average value of the length "x" of the enveloping cuboid which envelopes the respective domains satisfying afore mentioned condition preferably falls within the range of 0.5 μm or more and 15.0 μm or less. When the average value of the "x" is 0.5 μm or more, a charge is more effectively transferred towards an extension direction of the domains satisfying the condition.

In addition, when the average value of the "x" is 15.0 μm or less, a matrix-domain structure in which the respective domains are each independently present can be maintained. A method of calculating the "x" is described in Example 1.

<Electroconductive Mandrel>

An electroconductive mandrel appropriately selected from electroconductive mandrels known in the field of an electrophotographic electroconductive member may be used as the electroconductive mandrel 101. An example of a material for the mandrel is aluminum, stainless steel, a synthetic resin having electroconductivity, or a metal or an alloy, such as iron or a copper alloy. Further, such material may be subjected to oxidation treatment or plating treatment with chromium, nickel, or the like. Although any one of electroplating and electroless plating may be used as a method for the plating, the electroless plating is preferred from the viewpoint of dimensional stability. Examples of the kind of the electroless plating to be used herein may include nickel plating, copper plating, gold plating, and plating with other various alloys. The thickness of the plating is preferably 0.05 μm or more, and in consideration of a balance between working efficiency and a rust-proofing ability, the thickness of the plating is preferably from 0.1 μm to 30 μm. An example of the shape of the electroconductive mandrel may be a columnar shape or a hollow cylindrical shape. The outer diameter φ of the electroconductive mandrel preferably falls within the range of from 3 mm to 10 mm.

<Electroconductive Layer>

<Surface Resistance>

The charge generated by the triboelectric charging between the electrophotographic photosensitive member and the charging roller is charge generated on the surface of the charging roller. Accordingly, the surface shape of the electroconductive layer preferably has such a low resistance as not to impair a function as the charging roller. Specifically, a surface resistance value measured on the outer surface of the charging roller is preferably set within the range of $1.0\times10^{-1}\Omega$ or more and $1.0\times10^{3}\Omega$ or less. Thus, the charge generated on the surface can be more immediately transferred.

<Matrix>

The matrix contains the cross-linked product of the first rubber. The volume resistivity "m" of the matrix is preferably more than 1,000 times as large as the volume resistivity "d" of each of the domains to be described later. When the volume resistivity "m" of the matrix is more than 1,000 times as large as the volume resistivity "d" of each of the domains, the charge transfers to the domain that is a region having a low resistance in the electroconductive layer, and transfers along the direction in which the domain extends to the domain adjacent thereto. Accordingly, the charge generated by the triboelectric charging between the electrophotographic photosensitive member and the charging roller immediately transfers from the nip position of the charging roller to the non-nip position thereof. Thus, in the charging roller, a potential difference between its nip position with the electrophotographic photosensitive member and its non-nip position at the time of the start of its rotation is averaged. A method of measuring the volume resistivity of the matrix is described later.

<First Rubber>

The blending ratio of the first rubber is largest in a rubber composition for forming the electroconductive layer. The cross-linked product of the rubber dominates the mechanical strength of the electroconductive layer, and hence a rubber enabling the electroconductive layer to sufficiently express strength required in an electrophotographic electroconductive member after its cross-linking is preferably used as the first rubber. Examples of the first rubber include a natural rubber (NR), an isoprene rubber (IR), a butadiene rubber (BR), a styrene-butadiene rubber (SBR), a butyl rubber (IIR), a nitrile-butadiene rubber (NBR), an ethylene-propylene rubber (EPM), an ethylene-propylene-diene terpolymer rubber (EPDM), a chloroprene rubber (CR), and a silicone rubber.

<Reinforcing Agent>

A reinforcing agent may be incorporated into the matrix to the extent that the electroconductivity of the matrix is not affected. An example of the reinforcing agent is reinforcing carbon black having low electroconductivity. Specific examples of the reinforcing carbon black include fast extruding furnace (FEF) grade carbon black, general purpose furnace (GPF) grade carbon black, semi-reinforcing furnace (SRF) grade carbon black, and MT carbon.

Further, a filler, a processing aid, a vulcanization aid, a vulcanization accelerator, a vulcanization accelerator aid, a vulcanization retarder, an age resistor, a softening agent, a dispersant, a colorant, or the like, which is generally used as a blending agent for a rubber, may be added to the first rubber for forming the matrix as required.

<Ionic Electroconductive Agent>

The matrix may be blended with an ionic electroconductive agent for adjusting the resistance of the elastic layer of the charging roller within a middle-resistance region (e.g., from $1.0\times10^5\Omega$ to $1.0\times10^8\Omega$) suitable for the charging roller to the extent that the agent does not bleed out. For example, an inorganic ionic substance, a cationic surfactant, an amphoteric surfactant, a quaternary ammonium salt, and an organic acid lithium salt described below may each be used as the ionic electroconductive agent.

The inorganic ionic substance is lithium perchlorate, sodium perchlorate, calcium perchlorate, or the like. The cationic surfactant is lauryltrimethylammonium chloride, stearyltrimethylammonium chloride, octadecyltrimethylammonium chloride, or the like. Further, the cationic surfactant is dodecyltrimethylammonium chloride, hexadecyltrimethylammonium chloride, or the like. Further, the cationic surfactant is trioctylpropylammonium bromide, modified aliphatic dimethylethylammonium ethosulfate, or the like. The amphoteric surfactant is lauryl betaine, stearyl betaine, dimethylalkyllauryl betaine, or the like. The quaternary ammonium salt is tetraethylammonium perchlorate, tetrabutylammonium perchlorate, trimethyloctadecylammonium perchlorate, or the like. The organic acid lithium salt is lithium trifluoromethanesulfonate, or the like.

The blending amount of the above-mentioned ionic electroconductive agent is, for example, 0.5 part by mass or more and 5.0 parts by mass or less with respect to 100 parts by mass of the rubber composition.

<Roughening Particle>

Spherical particles each having a particle diameter in the range of, for example, from 1 μm to 90 μm may be added to the rubber composition for forming the matrix. An example of the particles is at least one spherical particle selected from the following particles:

phenol resin particles, silicone resin particles, polyacrylonitrile resin particles, polystyrene resin particles, polyurethane resin particles, nylon resin particles, polyethylene resin particles, polypropylene resin particles, acrylic resin particles, silica particles, and alumina particles. When such rubber composition is used, protrusions derived from the spherical particles can be formed on the outer surface of the elastic layer.

<Domain>

The domain 203 includes the cross-linked product of the second rubber and the electroconductive particle. Herein, the "electroconductive" is defined as having a volume resistivity of less than $1.0\times10^8$ Ω·cm.

<Second Rubber>

Specific examples of a rubber that may be used as the second rubber include the following rubbers:

NR, IR, BR, SBR, IIR, NBR, EPM, EPDM, CR, a silicone rubber, and a urethane rubber (UR).

<Electroconductive Particle>

Examples of the electroconductive particle include electronic electroconductive agents including: carbon materials, such as electroconductive carbon black and graphite; electroconductive oxides, such as titanium oxide and tin oxide; metals, such as Cu and Ag; and particles that are made electroconductive through coating of their surfaces with the electroconductive oxide or the metal. Those electroconductive particles may be used by being blended in appropriate amounts. Of those, electroconductive carbon black is preferably used as the electroconductive particles. Specific examples of the electroconductive carbon black include gas furnace black, oil furnace black, thermal black, lamp black, acetylene black, and ketjen black.

<Volume Resistivity>

To control the flow of the charge with the domains containing the electroconductive particles, the volume resistivity "d" of each of the domains is preferably 1,000 or more times as low as the volume resistivity "m" of the matrix. Thus, the charge can more easily transfer in each of the domains than in the matrix, and hence the charge transfers along the direction in which each of the domains extends. A specific method of measuring the volume resistivity of each of the domains is described in Example 1.

The thickness of the electroconductive layer is not particularly limited, but may preferably be from 0.5 mm (500 μm) to 5 mm.

<Process Cartridge>

Figure 8:
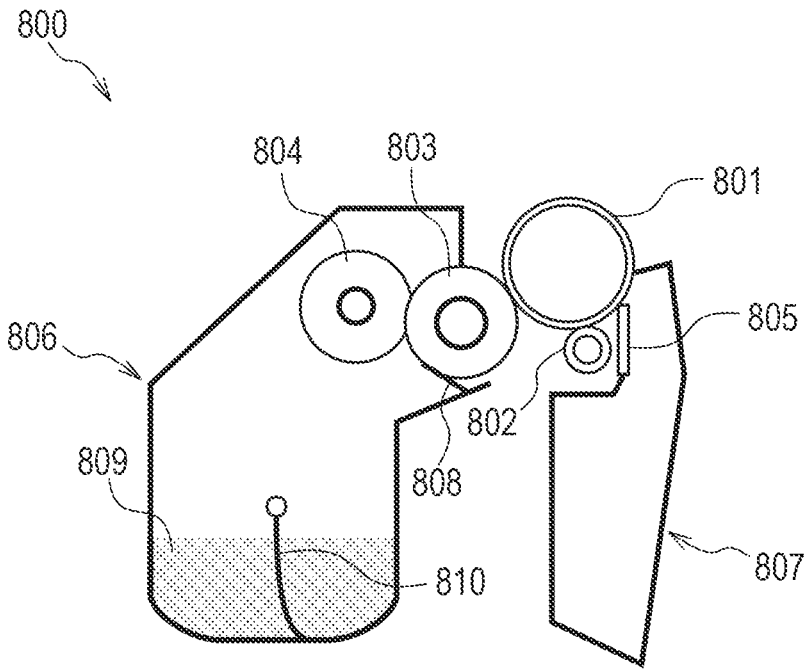
FIG. 8 is a sectional view of a process cartridge according to one embodiment of the present disclosure.

FIG. 8 is a schematic sectional view of an electrophotographic process cartridge including the charging roller according to one embodiment of the present disclosure. A process cartridge 800 illustrated in FIG. 8 is formed by integrating a developing device and a charging device so as to be detachably attachable to the main body of an electrophotographic image forming apparatus. The developing device is obtained by integrating at least a developing roller 803, a toner container 806, and a toner 809. A photosensitive drum 801 is an example of the electrophotographic photosensitive member. A charging roller 802 is arranged so as to be capable of charging the photosensitive drum 801. The developing device may include a toner-supplying roller 804, a developing blade 808, and a stirring blade 810 as required. The charging device is obtained by integrating at least the photosensitive drum 801 and the charging roller 802. A cleaning blade 805 for cleaning off residual toner on the photosensitive drum 801 is arranged so as to be brought into abutment with the photosensitive drum 801. In addition, the charging device includes a waste toner container 807 for recovering the residual toner that has been cleaned off. A voltage is applied to each of the charging roller 802, the developing roller 803, the toner-supplying roller 804, and the developing blade 808.

<Electrophotographic Image Forming Apparatus>

Figure 9:
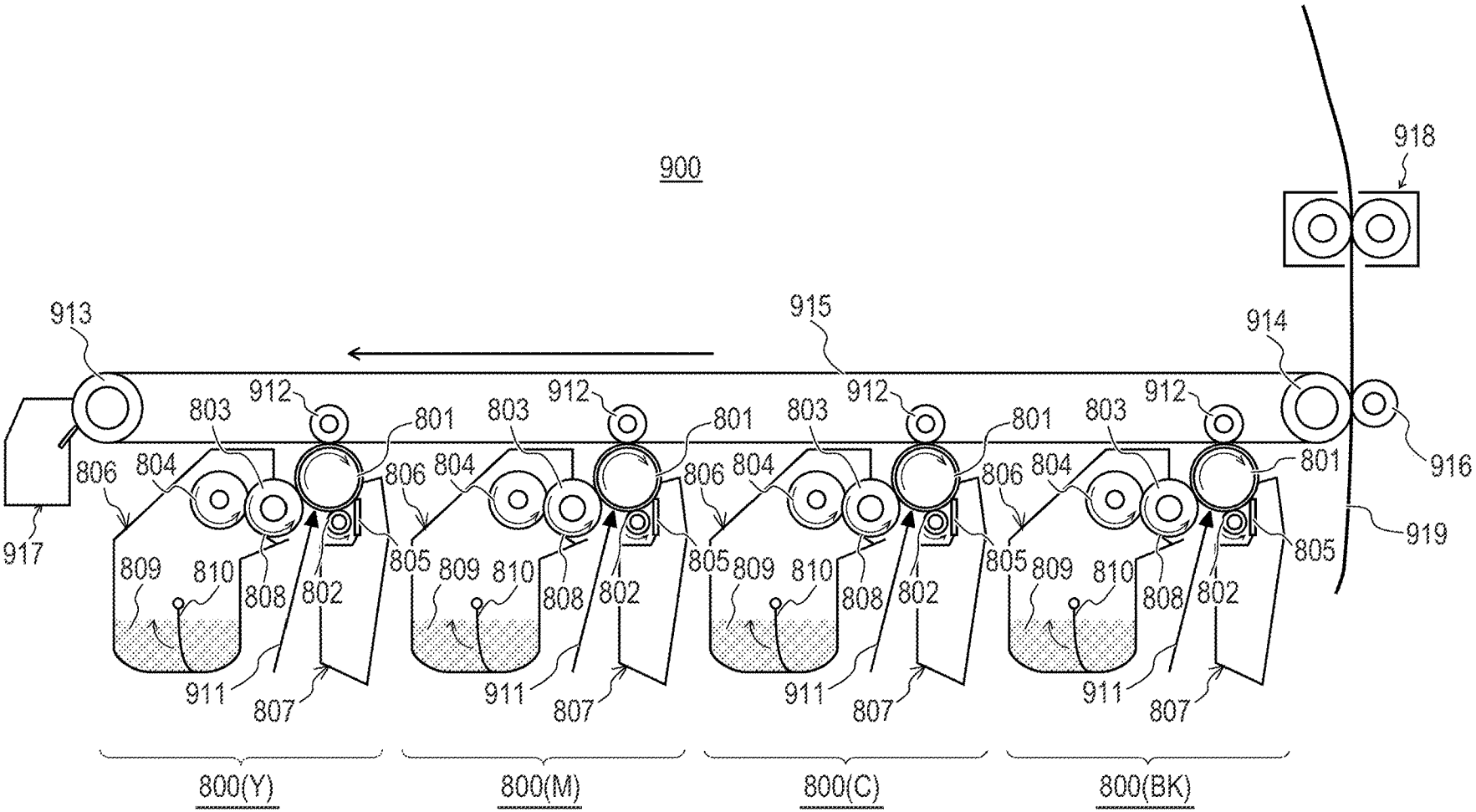
FIG. 9 is a sectional view of an electrophotographic image forming apparatus according to one embodiment of the present disclosure.

FIG. 9 is a schematic configuration view of an electrophotographic image forming apparatus 900 using the charging roller according to one embodiment of the present disclosure. The electrophotographic image forming apparatus 900 illustrated in FIG. 9 is formed so that the four process cartridges 800 are mounted so as to be detachably attachable thereto. The respective process cartridges 800 correspond to the respective colors of black (BK), magenta (M), yellow (Y), and cyan (C), and toners having the corresponding colors are used therein. The respective process cartridges 800 have the same configuration except that the colors of the toners to be used therein are different from each other.

The configuration of each of the process cartridges 800 is basically the same as that illustrated in FIG. 8. The process cartridges 800 each include the photosensitive drum 801, the charging roller 802, the developing roller 803, the toner-supplying roller 804, the cleaning blade 805, the toner container 806, the waste toner container 807, the developing blade 808, the toner 809, and the stirring blade 810.

The photosensitive drum 801 rotates in a direction indicated by the arrow, and is uniformly charged by the charging roller 802 to which a voltage has been applied from a charging bias power source (not shown). The irradiation of the surface of the photosensitive drum 801 with exposure light 911 results in the formation of an electrostatic latent image on the surface. Meanwhile, the toner 809 stored in the toner container 806 is supplied by the stirring blade 810 to the toner-supplying roller 804. The toner-supplying roller 804 supplies the toner 809 to the developing roller 803. The top of the surface of the developing roller 803 is uniformly coated with the toner 809 by the developing blade 808 arranged so as to be in contact with the developing roller 803, and charge is imparted to the toner 809 by triboelectric charging. The electrostatic latent image is developed by the application of the toner 809 conveyed by the developing roller 803 arranged so as to be in contact with the photosensitive drum 801, and is visualized as a toner image.

The visualized toner image on the photosensitive drum is transferred onto an intermediate transfer belt 915 by a primary transfer roller 912 to which a voltage has been applied by a primary transfer bias power source. The intermediate transfer belt 915 is driven while being supported by a tension roller 913 and an intermediate transfer belt-driving roller 914. The toner images of the respective colors are sequentially superimposed to form a color image on the intermediate transfer belt 915.

A transfer material 919 is fed into the apparatus by a sheet-feeding roller. The transfer material 919 is conveyed into a space between the intermediate transfer belt 915 and a secondary transfer roller 916. A voltage is applied from a secondary transfer bias power source to the secondary transfer roller 916, and hence the color image on the intermediate transfer belt 915 is transferred onto the transfer material 919. The transfer material 919 having transferred thereonto the color image is subjected to fixation treatment by a fixing unit 918. The transfer material 919 subjected to the fixation treatment is discharged to the outside of the apparatus.

Meanwhile, the toner remaining on the photosensitive drum 801 without being transferred is scraped off by the cleaning blade 805 to be stored in the waste toner-storing container 807. In addition, the toner remaining on the intermediate transfer belt 915 without being transferred is scraped off by a cleaning device 917 for the intermediate transfer belt.

<Method of Producing Charging Roller>

A method including the following steps (A) to (D) is described as a nonlimitative example of a method of producing the charging roller according to one aspect of the present disclosure:

step (A): a step of preparing a carbon masterbatch (hereinafter also referred to as "CMB") for forming domains, the masterbatch containing carbon black and a rubber;

step (B): a step of preparing a rubber composition serving as a matrix (hereinafter also referred to as "MRC");

step (C): a step of kneading the carbon masterbatch and the rubber composition to prepare a rubber composition having a matrix-domain structure; and step (D): a step of coating the periphery (surface) of the mandrel with the rubber composition having the matrix-domain structure.

With regard to factors for determining a domain diameter D in a matrix-domain structure in which two kinds of incompatible polymers are melted and kneaded, Taylor's equation, Wu's empirical equations, and Tokita's equation described below have been known (see Sumitomo Chemical's R & D Reports, 200341, pp. 44 to 45, "Structure Control by Kneading").

Taylor's equation $$D=[C\cdot\sigma/\eta m\cdot\gamma]\cdot f(\eta m/\eta d) \quad (1)$$

Wu's empirical equations $$\gamma\cdot D\cdot\eta m/\sigma=4(\eta d/\eta m)0.84\cdot\eta d/\eta m>1 \quad (2)$$

$$\gamma\cdot D\cdot\eta m/\sigma=4(\eta d/\eta m)-0.84\cdot\eta d/\eta m<1 \quad (3)$$

Tokita's equation $$D=12\cdot P\cdot\sigma\cdot\varphi(\pi\cdot\eta\cdot\gamma)\cdot(1+4\cdot P\cdot\varphi\cdot EDK/(\pi\cdot\eta\cdot\gamma)) \quad (4)$$

In the equations (1) to (4), D represents the domain diameter (maximum Feret diameter Df) of the CMB, C represents a constant, σ represents a surface tension, ηm represents the viscosity of a matrix, and ηd represents the viscosity of each of domains. In addition, γ represents a shear rate, η represents the viscosity of a mixed system, P represents a collision coalescence probability, φ represents a domain phase volume, and EDK represents domain phase cutting energy.

As can be seen from the equations (1) to (4), the control of, for example, the physical properties of the CMB and the MRC, and kneading conditions in the step (B) is effective in controlling the domain diameter D of the CMB. Specifically, the control of the following four items (a) to (d) is effective:

(a) a difference between surface tensions a of the CMB and the MRC;

(b) a ratio (ηm/ηd) between a viscosity (ηd) of the CMB and a viscosity (ηm) of the MRC;

(c) a shear rate (γ) at the time of kneading of the CMB and the MRC and an energy amount (EDK) at the time of shearing in the step (B); and (d) a volume fraction of the CMB to the MRC in the step (B).

Now, the items (a) to (d) are described in detail.

(a) Interface Tension Difference Between CMB and MRC;

In general, when two kinds of immiscible rubbers are mixed with each other, phase separation occurs. The reason for this is as described below. The interaction between similar polymers is stronger than that between dissimilar polymers, and hence the similar polymers are aggregated with each other to decrease free energy, thereby being stabilized. The interface of a phase separation structure is brought into contact with the dissimilar polymers, and hence the free energy thereof becomes higher than that of the inside that is stabilized due to the interaction between the similar polymers. As a result, interface tension for reducing an area that is brought into contact with the dissimilar polymers is generated in order to reduce the free energy of the interface. When the interface tension is small, even the dissimilar polymers attempt to be uniformly mixed with each other in order to increase entropy. A uniformly mixed state refers to dissolution, and a solubility parameter (SP) value serving as a guideline for solubility and the interface tension tend to correlate with each other. Specifically, it is conceived that the interface tension difference between the CMB and the MRC correlates with an SP value difference between the CMB and the MRC. Accordingly, the difference can be controlled by changing the combination of the MRC and the CMB.

Such rubbers that a difference between the absolute values of their solubility parameters is 0.4 $(J/cm^3)^{0.5}$ or more and 4.0 $(J/cm^3)^{0.5}$ or less are preferably selected as the first rubber in the MRC and the second rubber in the CMB. The difference between the absolute values of the solubility parameters is more preferably 0.4 $(J/cm^3)^{0.5}$ or more and 2.2 $(J/cm^3)^{0.5}$ or less. When the difference falls within such ranges, a stable phase separation structure can be formed.

<Method of Measuring SP Value>

The SP values of the MRC and the CMB can be calculated with satisfactory accuracy by creating a calibration curve through use of a material whose SP value is known. A catalog value of a material manufacturer may also be used as the known SP value. For example, the SP value of each of a NBR and a SBR is substantially determined from the content ratios of acrylonitrile and styrene independently of its molecular weight.

Accordingly, the SP value of each of the rubbers for forming the matrix and the domains can be calculated from the calibration curve obtained from the material whose SP value is known by analyzing the content ratio of acrylonitrile or styrene of the rubber.

Herein, analysis approaches, such as pyrolysis gas chromatography (Py-GC) and solid-state NMR, may each be used in the analysis of the content ratio of acrylonitrile or styrene. In addition, the SP value of an isoprene rubber is determined based on the structures of isomers, such as 1,2-polyisoprene, 1,3-polyisoprene, 3,4-polyisoprene, cis-1,4-polyisoprene, trans-1,4-polyisoprene, and the like. Accordingly, as in the SBR and the NBR, the SP value of the isoprene rubber can be calculated from the material whose SP value is known by analyzing its isomer content ratio through, for example, the Py-GC and the solid-state NMR.

(b) Viscosity Ratio Between CMB and MRC;

When the viscosity ratio ($\eta d/\eta m$) between the CMB and the MRC is closer to 1, the maximum Feret diameter of each of the domains reduces. The viscosity ratio between the CMB and the MRC may be adjusted by selecting the Mooney viscosity of each of the CMB and the MRC, or selecting the kind and blending amount of a filler. In addition, the viscosity ratio may be adjusted also by adding a plasticizer, such as paraffin oil, to such a degree as not to hinder the formation of the phase separation structure. Further, the viscosity ratio may be adjusted by adjusting the temperature at the time of kneading. The viscosity of each of the rubber mixture for forming domains and the rubber mixture for forming a matrix is obtained by measuring a Mooney viscosity ML (1+4) at a rubber temperature at the time of kneading in accordance with JIS K 6300-1:2013.

(c) Shear Rate at Time of Kneading of MRC and CMB and Energy Amount at Time of Shearing;

When the shear rate at the time of kneading of the MRC and the CMB is higher, and when the energy amount at the time of shearing is larger, the maximum Feret diameter Df of each of the domains reduces.

The shear rate may be increased by increasing the inner diameter of a stirring member, such as a blade or a screw, of a kneader to reduce a gap from the end surface of the stirring member to the inner wall of the kneader, or by increasing the rotation number of the stirring member. In addition, the energy amount at the time of shearing may be increased by increasing the rotation number of the stirring member, or by increasing the viscosity of each of the first rubber in the CMB and the second rubber in the MRC.

(d) Volume Fraction of CMB to MRC;

The volume fraction of the CMB to the MRC correlates with the probability that the rubber mixture for forming domains collides and coalesces with the rubber mixture for forming a matrix. Specifically, a reduction in volume fraction of the rubber mixture for forming domains to the rubber mixture for forming a matrix reduces the probability that the rubber mixture for forming domains and the rubber mixture for forming a matrix collide and coalesce with each other. In other words, when the volume fraction of the domains in the matrix is reduced to the extent that required electroconductivity is obtained, the sizes of the domains reduce.

In the above-mentioned step (C), the CMB serving as the domains and the MRC serving as the matrix are kneaded to produce an unvulcanized rubber composition having a matrix-domain structure. Examples of a production method for the composition may include methods described in the following (C1) and (C2).

(C1) Raw materials for each of the CMB serving as the domains and the unvulcanized rubber composition serving as the matrix are mixed with an internal mixer, such as a Banbury mixer or a pressure kneader. After that, the CMB serving as the domains, the unvulcanized rubber composition serving as the matrix, and a raw material, such as a vulcanizing agent or a vulcanization accelerator, are kneaded with an open mixer, such as an open roll, to be integrated.

(C2) The raw materials for the CMB serving as the domains are mixed with an internal mixer, such as a Banbury mixer or a pressure kneader. After that, the CMB serving as the domains and the raw materials for the unvulcanized rubber composition serving as the matrix are mixed with the internal mixer. Finally, the mixture and the raw material, such as a vulcanizing agent or a vulcanization accelerator, are kneaded with an open mixer, such as an open roll, to be integrated.

Examples of a method of coating the periphery of the mandrel with the rubber composition having the matrix-domain structure in the above-mentioned step (D) may include methods described in the following (D1) and (D2):

(D1) extrusion molding including extruding the rubber composition having the matrix-domain structure from a crosshead together with the mandrel to coat the periphery of the mandrel with the rubber composition having the matrix-domain structure; and (D2) die molding including coating the periphery of the mandrel arranged in a molding die with the rubber composition having the matrix-domain structure through use of the molding die.

Figure 6:
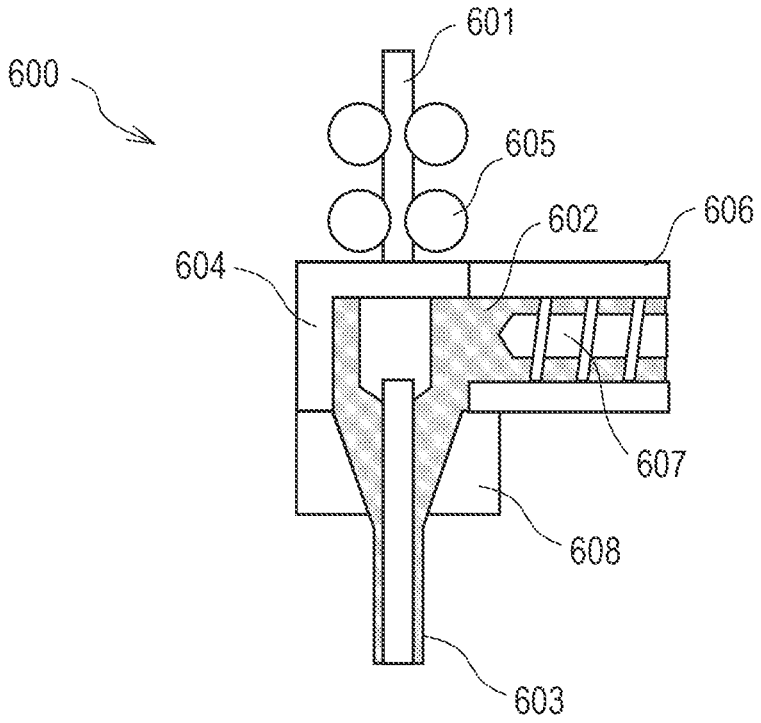
FIG. 6 is a view for illustrating the schematic configuration of a crosshead extrusion apparatus.

FIG. 6 is a schematic configuration view of an extrusion molding machine 600 including the crosshead to be used in the extrusion molding according to the (D1). The extrusion molding machine 600 coats the entire periphery of a mandrel 601 with an unvulcanized rubber composition 602 so that the composition has a uniform thickness, thereby producing an unvulcanized rubber roller 603.

The extrusion molding machine 600 has arranged therein a crosshead 604 into which the mandrel 601 and the unvulcanized rubber composition 602 are fed, a conveying roller 605 for feeding the mandrel 601 into the crosshead 604, and a cylinder 606 for feeding the unvulcanized rubber composition 602 into the crosshead 604.

The mandrels 601 are continuously introduced into the crosshead 604 by the conveying roller 605. The cylinder 606 includes a screw 607 in itself, and rotates the screw 607 to introduce the unvulcanized rubber composition 602 into the crosshead 604.

With regard to each of the mandrels 601 introduced into the crosshead 604, the peripheral surface of the mandrel 601 is coated with the unvulcanized rubber composition 602 introduced from the cylinder 606 into the crosshead 604. Then, the unvulcanized rubber roller 603 obtained by coating the peripheral surface of the mandrel 601 with the unvulcanized rubber composition 602 is fed from a die 608 serving as the outlet of the crosshead 604.

When the charging roller according to the present disclosure is produced by the method according to the (D1), the extended states of the domains may be controlled by, for example, materials, kneading conditions, and extrusion conditions.

First, as described above, the maximum Feret diameter Df of each of the domains in the matrix-domain structure can be controlled by the materials for the MRC and the CMB, and their kneading conditions. As the maximum Feret diameter Df of each of the domains becomes larger, the length "x" of the enveloping cuboid of the extended domain, which is formed by the step of extruding the rubber composition having the matrix-domain structure, in an X-axis direction becomes longer. Accordingly, to set the length "x" of the enveloping cuboid of the extended domain in the X-axis direction to a target value, the viscosity ratio between the CMB and the MRC, and the shear rate at the time of the kneading only need to be appropriately adjusted in accordance with the polymers to be used.

Next, the extrusion conditions are described. The inferior angle θ formed by the line segment P and the line segment Q illustrated in FIG. 5 can be adjusted by adjusting, in the extruding step of coextruding the rubber composition having the matrix-domain structure from the crosshead together with the mandrel to form a layer of the rubber composition on the outer peripheral surface of the mandrel, the flow rate of the rubber composition, the inner diameter of the die of the extruder, and the thickness of the layer of the rubber composition. The inferior angle θ can be made close to 90° by, for example, applying a larger shear stress (shear) to the rubber composition in the process for the formation of the layer of the rubber composition on the outer peripheral surface of the mandrel. Examples of a method of increasing the shear stress to be applied to the rubber composition in the extruding step with the crosshead include a reduction in inner diameter of the die and an increase in flow rate of the rubber composition. When the inner diameter of the die is reduced, the rubber composition to be extruded onto the outer peripheral surface of the mandrel is extended by a larger force. At this time, a larger shear force can be applied to a thickness region from a surface opposite to the side of the layer of the rubber composition in contact with the outer peripheral surface of the mandrel to a depth of 20.0 Accordingly, many of the domains present in the region can be extended in a direction along the moving direction of the mandrel, and as a result, 50 number % or more of all the domains in a cubic sample 20.0 μm on a side sampled from the region can each be made to satisfy the condition.

Next, the layer of the unvulcanized rubber composition obtained by the above-mentioned step (D), the layer containing the domains extending in the direction along the moving direction of the mandrel, then passes through a vulcanizing step serving as a step (E) to turn into the electroconductive layer. Thus, the charging roller according to this aspect can be obtained. Specific examples of a method of heating the layer of the rubber composition may include hot-air furnace heating with a gear oven, heating vulcanization with a far infrared ray, and steam heating with a vulcanizer. Of those, the hot-air furnace heating or the far infrared heating is preferred because of its suitability for continuous production.

The outer surface of the electroconductive layer according to the present disclosure formed by the above-mentioned method, the layer containing the domains each extending in a predetermined direction, is preferably free from being polished so that the domains present in a larger amount on a side close to the outer surface of the electroconductive layer, the domains each extending so that the inferior angle θ is 90° or less, do not disappear. Alternatively, even when the polishing is performed, the polishing is preferably performed so that the loss of the domains present in a larger amount on the side close to the outer surface of the electroconductive layer, the domains each extending so that the inferior angle θ is 90° or less, is suppressed to the extent possible. Accordingly, when the outer shape of the elastic layer of the charging roller according to this aspect is molded into a crown shape, extrusion molding is performed in consideration of such polishing. The outer shape of the unvulcanized rubber layer is preferably molded into the crown shape by, for example, controlling the speed at which the mandrel is extruded from the crosshead and the speed at which the unvulcanized rubber composition is extruded therefrom in the extrusion molding. Specifically, a relative ratio between the speed at which the mandrel 601 is fed by the conveying roller 605 and the speed at which the unvulcanized rubber composition is fed from the cylinder 606 is preferably changed. At this time, the speed at which the unvulcanized rubber composition 602 is fed from the cylinder 606 into the crosshead 604 is made constant. The thickness of the layer of the unvulcanized rubber composition 602 to be formed on the peripheral surface of the mandrel 601 is determined by the ratio between the feed speed of the mandrel 601 and the feed speed of the unvulcanized rubber composition 602. Thus, the elastic layer can be molded into the crown shape without performance of any polishing. In addition, in the die molding, slight polishing is preferably performed with a crown-shaped die to mold the outer shape of the unvulcanized rubber layer into the crown shape. The crown shape refers to such a shape that the outer diameter of the center portion of the elastic layer in the longitudinal direction of the mandrel is larger than the outer diameters of the end portions thereof.

A vulcanized rubber composition in both end portions of a vulcanized rubber roller is removed in a subsequent different step. Thus, a vulcanized rubber roller is completed. Accordingly, in the completed vulcanized rubber roller, both end portions of the mandrel are exposed.

The surface layer of the vulcanized rubber roller may be subjected to surface treatment based on irradiation with UV light or an electron beam to the extent that the matrix-domain structure and the shapes of the domains are not affected.

According to one aspect of the present disclosure, the charging roller conducive to stable formation of high-quality electrophotographic images under various environments can be obtained. In addition, according to another aspect of the present disclosure, the process cartridge conducive to stable provision of high-quality electrophotographic images can be obtained. Further, according to another aspect of the present disclosure, the electrophotographic image forming apparatus capable of stably forming a high-quality electrophotographic image can be obtained.

EXAMPLES

The following materials were prepared as materials to be used in the production of charging rollers according to Examples and Comparative Examples.

<NBR>

N230SV (product name: JSR NBR N230SV, manufactured by JSR Corporation)

DN401LL (product name: Nipol DN401LL, manufactured by ZEON Corporation)

<SBR>

T2003 (product name: Tufdene 2003, manufactured by Asahi Kasei Corporation)

A303 (product name: Asaprene 303, manufactured by Asahi Kasei Corporation)

<Chloroprene Rubber (CR)>

B31 (product name: SKYPRENE B31, manufactured by Tosoh Corporation)

<EPDM>

E505A (product name: Esprene 505A, manufactured by Sumitomo Chemical Co., Ltd.)

<Butadiene Rubber (BR)>

BR150B (product name: UBEPOL BR150B, manufactured by Ube Industries, Ltd.)

<Isoprene Rubber (IR)>

IR2200L (product name: Nipol IR2200L, manufactured by ZEON Corporation)

<Electroconductive Particle>

#7270 (product name: TOKABLACK #72705B, manufactured by Tokai Carbon Co., Ltd.)

#44 (product name: #44, manufactured by Mitsubishi Chemical Corporation)

#7360 (product name: TOKABLACK #73605B, manufactured by Tokai Carbon Co., Ltd.)

#5500 (product name: TOKABLACK #55005B, manufactured by Tokai Carbon Co., Ltd.)

<Vulcanizing Agent>

Sulfur (product name: SULFAX PMC, manufactured by Tsurumi Chemical Industry Co., Ltd.)

<Vulcanization Accelerator>

TBzTD (product name: Sanceler TBZTD, manufactured by Sanshin Chemical Industry Co., Ltd.)

TBSI (product name: SANTOCURE-TBSI, manufactured by FlexSys Inc.)

TS (product name: Sanceler TS, manufactured by Sanshin Chemical Industry Co., Ltd.)

CZ (product name: Nocceler CZ-G, manufactured by Ouchi Shinko Chemical Industrial Co., Ltd.)

TOT (product name: Nocceler TOT-N, manufactured by Ouchi Shinko Chemical Industrial Co., Ltd.)

<Vulcanization Accelerator Aid>

ZnO (product name: Zinc Oxide Type 2, manufactured by Sakai Chemical Industry Co., Ltd.)

<Roughening Particle>

PMMA particles (product name: SE-010T, manufactured by Negami Chemical Industrial Co., Ltd., average particle diameter: 10 μm)

Polyethylene particles (product name: Mipelon XM-221U, manufactured by Mitsui Chemicals, Inc., average particle diameter: 25 μm)

Polyurethane particles (product name: GRANDPEARL GU-2000P, manufactured by Aica Kogyo Company, Limited, average particle diameter: 20 μm)

<Reinforcing Material>

MT Carbon (product name: Thermax Floform N990, manufactured by CanCarb Limited)

Example 1

<Preparation of Carbon Masterbatch (CMB) 1>

The formulation of carbon masterbatch (CMB) raw materials is shown in Table 1. Blending amounts shown in Table 1 each represent a blending amount when the amount of a SBR to be used is set to 100 parts by mass. The carbon masterbatch (CMB) raw materials shown in Table 1 were mixed in the blending amounts shown in Table 1 to prepare a CMB 1. A 6-liter pressure kneader (product name: TD6-15MDX, manufactured by Toshin Co., Ltd.) was used as a mixer. The mixing was performed under the conditions of a filling ratio of 70 vol %, a blade rotation number of 30 rpm, and 16 minutes.

TABLE 1

| Material name "Product name" (manufacturer) | Blending amount [part(s)] |
|---|---|
| SBR "T2003" (manufactured by Asahi Kasei Corporation) | 100 |
| Carbon black "TOKABLACK #7270" (manufactured by Tokai Carbon Co., Ltd.) | 70 |
| Zinc oxide "Zinc Oxide Type 2" (manufactured by Sakai Chemical Industry Co., Ltd.) | 0.75 |
| Zinc stearate "SZ2000" (manufactured by Sakai Chemical Industry Co., Ltd.) | 0.15 |

<Preparation of Unvulcanized Rubber Composition 1>

The formulation of MRC raw materials to be used in the preparation of an A-kneaded rubber composition is shown in Table 2. Blending amounts shown in Table 2 each represent a blending amount when the amount of a NBR to be used is set to 100 parts by mass. The raw materials (MRC) shown in Table 2 were added to the CMB 1, and the mixture was kneaded to provide the A-kneaded rubber composition. At this time, a mixing ratio between the CMB 1 and the MRC was as follows: the amount of the SBR used in the CMB 1 was set to 25 parts by mass with respect to 75 parts by mass of the NBR to be used in the MRC. A 6-liter pressure kneader (product name: TD6-15MDX, manufactured by Toshin Co., Ltd.) was used as a mixer. The mixing was performed under the conditions of a filling ratio of 70 vol %, a blade rotation number of 30 rpm, and 16 minutes.

TABLE 2

| Material name "Product name" (manufacturer) | Blending amount [part(s)] |
|---|---|
| NBR "N230SV" (manufactured by JSR Corporation) | 100 |
| Calcium carbonate "Super #1700" (manufactured by Maruo Calcium Do., Ltd.) | 21.25 |
| Zinc oxide "Zinc Oxide Type 2" (manufactured by Sakai Chemical Industry Co., Ltd.) | 4.25 |
| Zinc stearate "SZ2000" (manufactured by Sakai Chemical Industry Co., Ltd.) | 0.85 |

The formulation of raw materials to be used in the preparation of a B-kneaded rubber composition is shown in Table 3. The raw materials shown in Table 3 were added to 100 parts by mass of the A-kneaded rubber composition obtained in the foregoing, and the mixture was further kneaded to provide an unvulcanized rubber composition 1 serving as the B-kneaded rubber composition. Open rolls each having a roll diameter of 12 inches (0.30 m) were used as mixers. The mixing was performed under the following conditions: the mixture was bilaterally cut a total of twenty times at a front roll rotation number of 10 rpm, a back roll rotation number of 8 rpm, and a roll gap of 2 mm, and was then subjected to tight milling ten times at a roll gap of 0.5 mm.

TABLE 3

| Material name "Product name" (manufacturer) | Blending amount [part(s)] |
|---|---|
| Sulfur "SULFAX PMC" (manufactured by Tsurumi Chemical Industry Co., Ltd.) | 5 |
| Vulcanization accelerator "TBzTD" (manufactured by Sanshin Chemical Industry Co., Ltd.) + "TBSI" (manufactured by FlexSys Inc.) | 1.5 + 1.5 |

<Molding of Vulcanized Rubber Layer>

First, a mandrel having an adhesion layer to which a vulcanized rubber layer was bonded was obtained. Specifically, a columnar electroconductive mandrel having a diameter of 6 mm and a length of 252 mm was used. The mandrel was made of steel and its surface was plated with nickel.

An electroconductive vulcanizing adhesive (product name: METALOC U-20; manufactured by Toyokagaku Kenkyusho Co., Ltd.) was applied to the center portion of the mandrel in its axial direction, and was dried at 80° C. for 30 minutes. The portion of the center portion having applied thereto the vulcanizing adhesive has a width of 222 mm.

The unvulcanized rubber composition 1 prepared in the foregoing was coextruded with an extrusion molding machine having a crosshead attached to its tip together with the mandrel having the adhesion layer to form a layer of the unvulcanized rubber composition 1 on the outer peripheral surface of the mandrel. Thus, a crown-shaped unvulcanized rubber roller was obtained. A molding temperature, the inner diameter of the cylinder 606 of the machine, and an extrusion screw rotation number were set to 100° C., 70 mm, and 20 rpm, respectively, and the flow rate of the rubber composition 1 to be introduced from the cylinder into the crosshead was set to 53 m/sec (the flow rate was calculated from the weight of the rubber portion of the molded unvulcanized rubber roller). In addition, the inner diameter of the die of the crosshead was 8.0 mm. In addition, to control the outer diameter of the center of the unvulcanized rubber roller in the direction along its axis and the outer diameters of the end portions thereof in the direction, while the feed speed of the mandrel was changed, the unvulcanized rubber roller was molded so that the outer diameter of the unvulcanized rubber roller became thicker than the inner diameter of the die. Specifically, the outer diameter of the center of the unvulcanized rubber roller in the direction along the axis was set to 8.6 mm, and the outer diameters of the end portions thereof in the direction were each set to 8.5 mm. After that, heating was performed in a hot-air furnace at a temperature of 190° C. for 60 minutes to vulcanize the layer of the unvulcanized rubber composition 1. Thus, a vulcanized rubber layer was obtained. Both end portions of the vulcanized rubber layer were cut so that its length in the axial direction became 232 mm. Thus, a vulcanized rubber roller was obtained.

<Irradiation of Vulcanized Rubber Layer after Extrusion with UV Light>

The surface of the resultant vulcanized rubber roller was irradiated with UV light. Thus, a charging roller 1 having a UV-treated region on the surface of its elastic layer (surface layer) was obtained. A low-pressure mercury lamp (product name: GLQ500US/11, manufactured by Toshiba Lighting & Technology Corporation) was used in the UV irradiation, and the vulcanized rubber roller was uniformly irradiated with the UV light while being rotated. The quantity of the UV light was set to 9,000 mJ/cm$^2$ when measured with the sensitivity of a sensor corresponding to a wavelength of 254 nm.

<Measurement of Surface Resistance Value of Charging Roller>

The produced charging roller was left at rest under an environment having a temperature of 23° C. and a relative humidity of 50% for 24 hours. After that, under the same environment, a DC voltage of 100 V was applied to the roller with the following meter and probes while the pressure at which the probes were each pressed against the roller was set to 10 μN, followed by the measurement of an electric current 1 second after the application of the voltage at a sampling period of 100 Hz for 2 seconds. The measurement was performed at the following three points: the center position of the electroconductive layer of the roller in its longitudinal direction, and positions distant from the center position by +90 mm and −90 mm in the longitudinal direction. Further, the measurement at each of the points was performed every 90° in the circumferential direction of the roller. The arithmetic average of the resultant measured values at the 12 points was defined as the surface resistance value of the charging roller.

High-resistance meter (product name: Model 6517B Electrometer, Keithley Instruments)

Probes (200 μm pitch, two probes)

The surface resistance value obtained by the above-mentioned measurement is shown in Table 5 (Table 5 is shown in the final part of the following description).

<Recognition of Presence or Absence of Domain and Measurement of Domain Shape>

The three-dimensional reconstruction of a rubber piece cut out of the charging roller was performed through use of a FIB-SEM with a cryogenic system. Helios G4 UC (manufactured by Thermo Fisher Scientific) and Cryo Transfer System PP3010T (manufactured by Quorum Technologies) may be used as the FIB-SEM with a cryogenic system. The resultant three-dimensional reconstruction data was analyzed with image analysis software (AVIZO, manufactured by Thermo Fisher Scientific), followed by the recognition of the presence or absence of a domain and the measurement of a domain shape. Specific treatment is described below.

The longitudinal direction of the charging roller is represented by "a-axis", and the tangential direction of an arc drawn by the surface of the roller in a section of the roller perpendicular to the longitudinal direction of "a-axis" is represented by "b-axis". A razor blade was vertically brought into contact with the surface of the roller to cut the surface so that a quadrangle having a width in the "b-axis" direction of 5 mm and a length in the "a-axis" direction of 5 mm with the point of contact between the arc and the tangent as a center was able to be formed. Finally, a portion of the roller in contact with the mandrel was cut out in a shape along the mandrel to produce a rubber piece measuring 5 mm in the "a-axis" direction by 5 mm in the "b-axis" direction and having a thickness corresponding to the thickness of the vulcanized rubber layer.

The rubber piece was cut out from 12 points, including, in the circumferential direction of the charging roller, every 90°, and in the longitudinal direction of the charging roller, a center position and positions distant from the center position by +90 mm and −90 mm. Thus, total 12 rubber pieces were prepared.

Each of the rubber pieces was stuck to a copper-made columnar stub having a diameter of 10 mm with a silver paste so that its portion that had been the surface of the roller faced upward. The resultant was dried at room temperature (25° C.) for 1 hour to provide an observation sample.

The three-dimensional reconstruction of the observation sample was performed through use of a FIB-SEM with a cryogenic system (device name: Helios G4 UC, manufactured by Thermo Fisher Scientific and Cryo Transfer System PP3010T, manufactured by Quorum Technologies).

That is, the observation sample was cooled to −170° C. by using the cryogenic system. Then the frozen observation sample was processed by focused ion beam (FIB) so that a square shaped cross section having 20.0 μm a side from a surface of the observation sample, corresponding to the outer surface of the charging roller to a depth direction, hereinafter referred to as "c direction", and 20.0 μm a side in the b-axis direction. The squared shaped cross section may be referred to as "a first b-c surface". At this time, FIB processing was performed under the conditions of an acceleration voltage of 30 kV and an electric current of 1.6 nA. Next, SEM image of the first b-c surface was obtained. Herein, a surface directly below the protective film along the "b" direction was defined as an observation surface C. The observation surface C was observed with a SEM. The observation was performed under the conditions of an acceleration voltage of 350 V and an electric current of 13 pA through use of a secondary electron image. Then, the first b-c surface was cut by 100 nm in the direction of the a-axis to expose a second b-c surface. Then, SEM image of the second b-c surface was obtained. The cutting of observed b-c surface, and obtaining of SEM image of a newly exposed b-c surface was repeated so that the cutting amount in the a-axis direction was reached to 20.0 μm, and 200 of SEM images of b-c surfaces were obtained. By using those SEM images, three-dimensional reconstruction was performed with image analysis software (AVIZO, manufactured by Thermo Fisher Scientific) to reconstruct the cubic sample of the electroconductive layer having a side of 20.0 μm from a region from an outer surface of the electroconductive layer to a depth of 20.0 μm.

All the domains observed in 12 of the reconstructed three-dimensional images were enveloped by imaginary enveloping cuboids each having two surfaces each of which is perpendicular to a line segment L passing through at least one arbitrary point in the respective domains and being perpendicular to a surface of the mandrel. Here, among three sides constituting tree axes of the respective enveloping cuboids, an axis to which a longest side belongs is defined as X-axis, and other two axes to which other two sides belong are defined Y-axis and Z-axis. Further, the domains enveloped by the enveloping cuboids were the domains completely contained in the three-dimensional images. That is, a domain only a part of which is contained in the three-dimensional image was ineligible for the enveloping by the enveloping cuboid. By using the enveloping cuboids, following three items are calculated.

Number % of Extended Domains

Among all the enveloping cuboids in the 12 three-dimensional images, a number of the enveloping cuboids satisfying the condition, i.e., a line segment S that is perpendicular to the line segment L and is parallel to an X-axis is able to be drawn, was counted. Then, the counted number was divided by the total number of the enveloping cuboids, and the number % of the extended domains was obtained.

Inferior Angle θ Formed by Line Segment P and Line Segment Q

Figure 7:
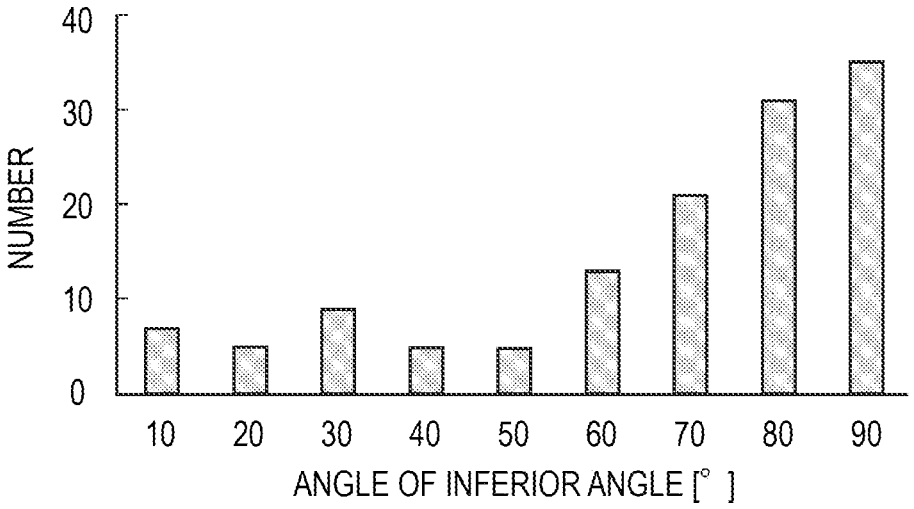
FIG. 7 is a histogram summarizing the angular distribution of inferior angles.

As to all the enveloping cuboids, a longest line segment out of line segments connecting a portion of a first YZ surface in contact with the enveloped domain and a portion of a second YZ surface in contact with the enveloped domain was defined as a ling segment P, and a line segment Q having a same starting point of the line segment P in the first or the second YZ surface, and being perpendicular to the surface of the mandrel was drawn. Then, the inferior angle θ, which is defined as an inferior angle formed by the line segments P and line segments Q was measured. After that, a histogram showing a relationship between the inferior angle θ ranging from 0° to 90° in crass interval of 10°, and the number of the enveloping cuboids belonging to respective classes was created (FIG. 7). In the histogram, the mode value of the inferior angle was defined as the inferior angle θ of the evaluated charging roller.

Average Value of the Length "x" of Enveloping Cuboid in X-Axis Direction

As to the enveloping cuboid(s) which can draw the line segment S, the length "x" in the X-axis thereof was measured, and the arithmetic average value thereof was calculated. The value is a parameter showing the degree of domain extension towards the longitudinal direction of the evaluated charging roller.

Those results are shown in Table 5.

<Measurement of Volume Resistivity Ratio m/d Between Matrix and Domains>

The following measurement was performed for evaluating the volume resistivity of a matrix in the electroconductive layer. A scanning probe microscope (SPM) (product name: Q-Scope 250, manufactured by Quesant Instrument Corporation) was operated in a contact mode.

First, an extremely thin segment having a thickness of 1 μm was cut out of the electroconductive layer of an electroconductive member A1 with a microtome (product name: Leica EM FCS, manufactured by Leica Microsystems) at a cutting temperature of −100° C. When the extremely thin segment was cut out, in consideration of the direction in which charge was transported for discharge, the cutting was performed in the direction of a section perpendicular to the longitudinal direction of the electroconductive member. Next, the extremely thin segment was placed on a metal plate in an environment having a temperature of 23° C. and a relative humidity of 50%. Then, sites in direct contact with the metal plate were selected, and the cantilever of the SPM was brought into contact with a site corresponding to the matrix. Under this state, a voltage of 50 V was applied to the cantilever for 5 seconds, and current values were measured, followed by the calculation of the arithmetic average value of the values measured during the 5-second period.

The surface shape of the measurement segment was observed with the SPM, and the thickness of the measured site was calculated from the resultant height profile. Further, the area of the matrix was calculated from the observation result of the surface shape. A volume resistivity was calculated from the thickness and the area of the matrix, and was defined as the volume resistivity "m" of the matrix.

The electroconductive layer of the electroconductive member A1 (length in the longitudinal direction: 232 mm) was divided into five equal parts in the longitudinal direction, and was further divided into four equal parts in its circumferential direction. The segment was produced from one arbitrary point in each of the resultant regions, that is, the segments were produced from a total of 20 points, followed by the performance of the measurement. The average value of the measured values was defined as the volume resistivity "m" of the matrix.

To evaluate the volume resistivity "d" of each of the domains in the electroconductive layers, the volume resistivity "d" of each of the domains was measured by the same method except that in the measurement of the volume resistivity "m" of the matrix described above, the measurement was performed at sites of the extremely thin segment corresponding to the domains, and the voltage at the time of the measurement was set to 1 V A volume resistivity ratio m/d between the matrix and the domains calculated from the volume resistivity "m" of the matrix and the volume resistivity "d" of each of the domains thus obtained is shown in Table 5.

<Evaluation of Horizontal Streak Image>

An electrophotographic image forming apparatus (product name: LaserJet M608dn, manufactured by Hewlett-Packard Company) was prepared. To perform an evaluation in a high-speed process, the electrophotographic image forming apparatus was reconstructed so that its number of sheets to be output per unit time became 80 sheets of A4-size paper per minute, which was larger than its original number of sheets to be output.

First, the charging roller, the electrophotographic image forming apparatus, and a process cartridge were left in an environment having a temperature of 15° C. and a relative humidity of 10% for 48 hours for the purpose of accustoming the roller, the apparatus, and the cartridge to the measurement environment.

Next, the charging roller was incorporated as the charging roller of the process cartridge.

A halftone image was output with the apparatus and the cartridge, and the output image was evaluated. At the time of the start of the rotation of the electrophotographic photosensitive member of the cartridge, charge is generated at a nip position between the electrophotographic photosensitive member and the charging roller by triboelectric charging therebetween. The charge transfers from the surface of the charging roller to the domain having a low resistance in the charging roller. When the charge present in the domain remains at the time of a charging step, a horizontal streak image having a low density is produced by overdischarge. The horizontal streak image was evaluated as described below. The result of the evaluation is show in Table 5.

The horizontal streak image was scanned with a scanner (product name: image RUNNER ADVANCE C5240F, manufactured by Hewlett-Packard Company) so that its horizontal streak was directed in a horizontal direction. Thus, a jpeg data image was obtained. At this time, a scan resolution was set to 400×400 dpi. The resultant jpeg data image of the horizontal streak image was subjected to bitmap analysis with image analysis software (product name: Image-Pro, Hakuto Co., Ltd.). The bitmap analysis enables comparison between the light and shade of the image in terms of numerical values. In other words, the extent to which the horizontal streak occurs can be quantitatively evaluated by determining a bit value difference that is a difference in bit value between a horizontal streak portion where the horizontal streak occurs and a non-horizontal streak portion where no horizontal streak occurs. A specific calculation method is as described below. A horizontal-direction average bit value for each pixel in a vertical direction was determined by determining the arithmetic average of the bit values of the region having printed thereon the halftone image in a horizontal direction (longitudinal direction in the charging roller) for each pixel in the vertical direction. Then, a difference between the highest horizontal-direction average bit value of a horizontal streak position and the horizontal-direction average bit value of a non-horizontal streak position was defined as the bit value difference. The bit value difference was evaluated by the following criteria.

Rank A: The bit value difference is 0.00 or more and 0.46 or less.

(The occurrence of a horizontal streak cannot be recognized with a loupe.)

Rank B: The bit value difference is 0.47 or more and 0.83 or less.

(The occurrence of a horizontal streak can be recognized with a loupe, but cannot be recognized with a naked eye.)

Rank C: The bit value difference is 0.84 or more and 1.91 or less.

(It can be recognized with a naked eye that a horizontal streak occurs extremely thinly and discontinuously over the longitudinal direction.)

Rank D: The bit value difference is 1.92 or more.

(It can be recognized with a naked eye that a horizontal streak occurs extremely thinly and continuously over the longitudinal direction.)

Examples 2 to 42

The formulations of unvulcanized rubber compositions according to Examples 2 to 42, and the rotation number of a pressure kneader blade at the time of the A kneading of each of the unvulcanized rubber compositions are shown in Table 4-1.

In addition, conditions for the extrusion of the unvulcanized rubber compositions according to Examples 2 to 36 and 38 to 42 are shown in Table 4-2.

Further, conditions for the vulcanization of unvulcanized rubber rollers according to Examples 2 to 42, the integrated quantity of UV light used in the surface treatment of each of the rollers or the quantity of an electron beam (EB) used in the treatment, and the presence or absence of the polishing of the outer surface of the electroconductive layer of each of the rollers after the vulcanization are shown in Table 4-3.

TABLE 4-1

| | Unvulcanized rubber composition | | | | | | | | | | Rotation number of pressure kneader blade at time of A kneading of unvulcanized rubber composition [rpm] |
|---|---|---|---|---|---|---|---|---|---|---|---|
| | MRC First rubber | | CMB Second rubber | | CMB Electroconductive particle | | Vulcanization accelerator | | Roughening particle | Reinforcing material | |
| Example | Rubber kind | Abbreviation | Rubber kind | Abbreviation | Abbreviation | Number of parts | Material abbreviation | Number of parts | (Number of parts) | (Number of parts) | |
| 1 | NBR | N230SV | SBR | T2003 | #7270 | 70 | TBzTD + TBSI | 1.5 + 1.5 | — | — | 30 |
| 2 | NBR | N230SV | SBR | T2003 | #7270 | 70 | TBzTD + TBSI | 1.5 + 1.5 | — | — | 30 |
| 3 | NBR | N230SV | SBR | T2003 | #7270 | 70 | TBzTD + TBSI | 1.5 + 1.5 | — | — | 30 |
| 4 | NBR | N230SV | SBR | T2003 | #7270 | 70 | TBzTD + TBSI | 1.5 + 1.5 | — | — | 30 |
| 5 | NBR | N230SV | SBR | T2003 | #7270 | 70 | TBzTD + TBSI | 1.5 + 1.5 | — | — | 30 |
| 6 | NBR | N230SV | SBR | T2003 | #7270 | 70 | TBzTD + TBSI | 1.5 + 1.5 | — | — | 30 |
| 7 | NBR | N230SV | SBR | T2003 | #7270 | 70 | TBzTD + TBSI | 1.5 + 1.5 | — | — | 30 |
| 8 | NBR | N230SV | SBR | T2003 | #7270 | 70 | TBzTD + TBSI | 1.5 + 1.5 | — | — | 30 |
| 9 | NBR | N230SV | SBR | T2003 | #7270 | 70 | TBzTD + TBSI | 1.5 + 1.5 | — | — | 30 |
| 10 | NBR | N230SV | SBR | T2003 | #7270 | 70 | TBzTD + TBSI | 1.5 + 1.5 | — | — | 30 |
| 11 | NBR | N230SV | SBR | T2003 | #7270 | 70 | TBzTD + TBSI | 1.5 + 1.5 | — | — | 30 |
| 12 | NBR | N230SV | SBR | T2003 | #7270 | 70 | TBzTD + TBSI | 1.5 + 1.5 | — | — | 30 |
| 13 | NBR | N230SV | SBR | T2003 | #7270 | 70 | TBzTD + TBSI | 1.5 + 1.5 | — | — | 30 |
| 14 | NBR | N230SV | SBR | T2003 | #7270 | 70 | TBzTD + TBSI | 1.5 + 1.5 | — | — | 30 |
| 15 | NBR | N230SV | SBR | T2003 | #7270 | 70 | TBzTD + TBSI | 1.5 + 1.5 | — | — | 30 |
| 16 | NBR | N230SV | SBR | T2003 | #7270 | 70 | TBzTD + TBSI | 1.5 + 1.5 | — | — | 30 |
| 17 | NBR | N230SV | SBR | T2003 | #7270 | 70 | TBzTD + TBSI | 1.5 + 1.5 | — | — | 30 |
| 18 | NBR | N230SV | SBR | T2003 | #7270 | 70 | TBzTD + TBSI | 1.5 + 1.5 | — | — | 30 |
| 19 | NBR | N230SV | SBR | T2003 | #7270 | 70 | TBzTD + TBSI | 1.5 + 1.5 | — | — | 20 |
| 20 | NBR | N230SV | SBR | T2003 | #7270 | 70 | TBzTD + TBSI | 1.5 + 1.5 | — | — | 35 |
| 21 | NBR | N230SV | SBR | T2003 | #7270 | 70 | TBzTD + TBSI | 1.5 + 1.5 | — | — | 15 |
| 22 | NBR | N230SV | SBR | T2003 | #7270 | 70 | TBzTD + TBSI | 1.5 + 1.5 | — | — | 40 |
| 23 | NBR | N230SV | SBR | T2003 | #7270 | 30 | TBzTD + TBSI | 1.5 + 1.5 | — | — | 30 |
| 24 | NBR | N230SV | SBR | T2003 | #7270 | 10 | TBzTD + TBSI | 1.5 + 1.5 | — | — | 30 |
| 25 | NBR | N230SV | CR | B31 | #7270 | 70 | TS + ZnO | 0.5 + 0.5 | — | — | 30 |
| 26 | SBR | T2003 | NBR | N230SV | #7270 | 70 | TBzTD + TBSI | 1.5 + 1.5 | — | — | 30 |
| 27 | NBR | N230SV | SBR | A303 | #7270 | 70 | TBzTD + TBSI | 1.5 + 1.5 | — | — | 30 |
| 28 | NBR | DN401LL | SBR | T2003 | #7270 | 70 | TBzTD + TBSI | 1.5 + 1.5 | — | — | 30 |
| 29 | NBR | N230SV | SBR | T2003 | #44 | 70 | TBzTD + TBSI | 1.5 + 1.5 | — | — | 30 |
| 30 | NBR | N230SV | SBR | T2003 | #7360 | 70 | TBzTD + TBSI | 1.5 + 1.5 | — | — | 30 |
| 31 | NBR | N230SV | SBR | T2003 | #5500 | 70 | TBzTD + TBSI | 1.5 + 1.5 | — | — | 30 |
| 32 | NBR | N230SV | SBR | T2003 | #7270 | 70 | TBSI | 3 | — | — | 30 |
| 33 | NBR | N230SV | SBR | T2003 | #7270 | 70 | TBzTD + TBSI | 1.5 + 1.5 | PMMA particles (20 parts) | — | 30 |
| 34 | NBR | N230SV | SBR | T2003 | #7270 | 70 | TBzTD + TBSI | 1.5 + 1.5 | Polyethylene particles (20 parts) | — | 30 |
| 35 | NBR | N230SV | SBR | T2003 | #7270 | 70 | TBzTD + TBSI | 1.5 + 1.5 | Polyurethane particles (20 parts) | — | 30 |
| 36 | NBR | N230SV | SBR | T2003 | #7270 | 70 | TBzTD + TBSI | 1.5 + 1.5 | — | MT carbon (10 parts) | 30 |
| 37 | NBR | N230SV | SBR | T2003 | #7270 | 70 | TBzTD + TBSI | 1.5 + 1.5 | — | — | 30 |
| 38 | NBR | N230SV | SBR | T2003 | #7270 | 70 | TBzTD + TBSI | 1.5 + 1.5 | — | — | 30 |
| 39 | EPDM | E505A | BR | BR150B | #7270 | 70 | CZ + TOT | 1.5 + 1.5 | — | — | 30 |
| 40 | IR | IR2200L | NBR | N230SV | #7270 | 70 | CZ + TOT | 1.5 + 1.5 | — | — | 30 |
| 41 | BR | BR150B | SBR | T2003 | #7270 | 70 | TBzTD + TBSI | 1.5 + 1.5 | — | — | 30 |
| 42 | NBR | DN401LL | EPDM | E505A | #7270 | 70 | CZ + TOT | 1.5 + 1.5 | — | — | 30 |

TABLE 4-2

| | Extrusion condition | | |
|---|---|---|---|
| Example | Die diameter (mm) | Screw rotation number (rpm) | Rubber flow rate (mm/sec) |
| 1 | 8.0 | 20 | 53 |
| 2 | 8.0 | 20 | 53 |
| 3 | 8.0 | 14 | 37 |

TABLE 4-2-continued

| | Extrusion condition | | |
|---|---|---|---|
| Example | Die diameter (mm) | Screw rotation number (rpm) | Rubber flow rate (mm/sec) |
| 4 | 8.0 | 13 | 35 |
| 5 | 8.2 | 20 | 48 |
| 6 | 8.2 | 14 | 33 |

TABLE 4-2-continued

| Example | Extrusion condition: Die diameter (mm) | Screw rotation number (rpm) | Rubber flow rate (mm/sec) |
|---|---|---|---|
| 7 | 8.2 | 13 | 31 |
| 8 | 8.0 | 14 | 37 |
| 9 | 8.0 | 13 | 35 |
| 10 | 8.2 | 20 | 48 |
| 11 | 8.2 | 14 | 33 |
| 12 | 8.2 | 13 | 31 |
| 13 | 8.0 | 20 | 53 |
| 14 | 8.0 | 14 | 37 |
| 15 | 8.0 | 13 | 35 |
| 16 | 8.2 | 20 | 48 |
| 17 | 8.2 | 14 | 33 |
| 18 | 8.2 | 13 | 31 |
| 19 | 8.0 | 20 | 53 |
| 20 | 8.0 | 20 | 53 |
| 21 | 8.0 | 20 | 53 |
| 22 | 8.0 | 20 | 53 |
| 23 | 8.0 | 20 | 53 |
| 24 | 8.0 | 20 | 53 |
| 25 | 8.0 | 20 | 51 |
| 26 | 8.0 | 20 | 52 |
| 27 | 8.0 | 20 | 53 |
| 28 | 8.0 | 20 | 53 |
| 29 | 8.0 | 20 | 53 |
| 30 | 8.0 | 20 | 53 |
| 31 | 8.0 | 20 | 53 |
| 32 | 8.0 | 20 | 53 |
| 33 | 8.0 | 20 | 55 |
| 34 | 8.0 | 20 | 55 |
| 35 | 8.0 | 20 | 55 |
| 36 | 8.0 | 20 | 53 |
| 37 | 8.0 | 20 | 53 |
| 38 | — | — | — |
| 39 | 8.0 | 20 | 58 |
| 40 | 8.0 | 20 | 55 |
| 41 | 8.0 | 20 | 55 |
| 42 | 8.0 | 20 | 54 |

TABLE 4-3

| Example | Vulcanization condition | Integrated quantity of UV light used in surface treatment [mJ/cm$^2$] | Quantity of EB used in treatment | Polishing |
|---|---|---|---|---|
| 1 | 190° C._1 h | 9,000 | — | — |
| 2 | 100° C._0.5 h + 190° C._1 h | 9,000 | — | — |
| 3 | 100° C._0.5 h + 190° C._1 h | 9,000 | — | — |
| 4 | 100° C._0.5 h + 190° C._1 h | 9,000 | — | — |
| 5 | 100° C._0.5 h + 190° C._1 h | 9,000 | — | — |
| 6 | 100° C._0.5 h + 190° C._1 h | 9,000 | — | — |
| 7 | 100° C._0.5 h + 190° C._1 h | 9,000 | — | — |
| 8 | 190° C._1 h | 9,000 | — | — |
| 9 | 190° C._1 h | 9,000 | — | — |
| 10 | 190° C._1 h | 9,000 | — | — |
| 11 | 190° C._1 h | 9,000 | — | — |
| 12 | 190° C._1 h | 9,000 | — | — |
| 13 | 190° C._1 h | 9,000 | — | ○ |
| 14 | 190° C._1 h | 9,000 | — | ○ |
| 15 | 190° C._1 h | 9,000 | — | ○ |
| 16 | 190° C._1 h | 9,000 | — | ○ |
| 17 | 190° C._1 h | 9,000 | — | ○ |
| 18 | 190° C._1 h | 9,000 | — | ○ |
| 19 | 190° C._1 h | 9,000 | — | — |
| 20 | 190° C._1 h | 9,000 | — | — |
| 21 | 190° C._1 h | 9,000 | — | — |
| 22 | 190° C._1 h | 9,000 | — | — |
| 23 | 190° C._1 h | 9,000 | — | — |

TABLE 4-3-continued

| Example | Vulcanization condition | Integrated quantity of UV light used in surface treatment [mJ/cm$^2$] | Quantity of EB used in treatment | Polishing |
|---|---|---|---|---|
| 24 | 190° C._1 h | 9,000 | — | — |
| 25 | 190° C._1 h | 9,000 | — | — |
| 26 | 190° C._1 h | 9,000 | — | — |
| 27 | 190° C._1 h | 9,000 | — | — |
| 28 | 190° C._1 h | 9,000 | — | — |
| 29 | 190° C._1 h | 9,000 | — | — |
| 30 | 190° C._1 h | 9,000 | — | — |
| 31 | 190° C._1 h | 9,000 | — | — |
| 32 | 190° C._1 h | 9,000 | — | — |
| 33 | 190° C._1 h | 9,000 | — | — |
| 34 | 190° C._1 h | 9,000 | — | — |
| 35 | 190° C._1 h | 9,000 | — | — |
| 36 | 190° C._1 h | 9,000 | — | — |
| 37 | 190° C._1 h | — | 1,500 | — |
| 38 | — | 9,000 | — | — |
| 39 | 160° C._1 h | 9,000 | — | — |
| 40 | 140° C._1 h | 9,000 | — | — |
| 41 | 160° C._1 h | 9,000 | — | — |
| 42 | 160° C._1 h | 9,000 | — | — |

In the polishing according to each of Examples 13 to 18, a rotary grinding stone was brought into abutment with the outer surface of the electroconductive layer to remove a thickness of 10 μm. Thus, such a crown-shaped charging roller that the diameter of each of both end portions in its longitudinal direction was 8.5 mm and the diameter of its center portion was 8.6 mm was obtained. Many domains each extending so that the inferior angle θ was 90° or less were present in a region from the outer surface of the electroconductive layer before the polishing to a depth of 20 μm. Accordingly, the domains each having an inferior angle θ of 90° or less were able to be caused to remain in the electroconductive layer after the polishing by setting the polishing amount to 10 μm.

In the electron beam irradiation in Example 37, an electron beam irradiation apparatus (manufactured by Iwasaki Electric Co., Ltd.) having a maximum acceleration voltage of 150 kV and a maximum electronic current of 40 mA was used, and was filled with nitrogen at the time of the irradiation. Conditions for the electron beam irradiation are described below.

Acceleration voltage: 150 kV
Electronic current: 35 mA
Dose: 1,323 kGy
Treatment speed: 1 m/min
Oxygen concentration: 100 ppm Further, in Example 38, press molding was performed with the unvulcanized rubber composition 1 prepared in the same manner as in Example 1. A split die and a pressing machine were used in the press molding. In the split die heated to 160° C., the mandrel that had been similarly heated was arranged, and the unvulcanized rubber composition was arranged in an amount exceeding the volume of the split die along the mandrel. The arranged unvulcanized rubber composition had a weight of 10 g. The press molding was performed while the split die having arranged therein the mandrel and the unvulcanized rubber composition was heated. After that, burrs produced by the molding and both end portions of the vulcanized rubber layer were removed, and UV treatment was performed in the same manner as in Example 1. Thus, a charging roller having a length in its axial direction of 232 mm, a center outer diameter of 8.6 mm, and an end portion outer diameter of 8.5 mm was obtained. Conditions for the molding are described below.

Pressure: 10 MPa

Temperature: 160° C.

Time: 40 minutes

The surface resistance values of the charging rollers produced in Examples 2 to 42, the inferior angle formed by the line segment P and the line segment Q in the extended domain of each of the rollers, the length of the "x" of the enveloping cuboid of the domain, the volume resistivity ratio m/d between the matrix and domains of each of the rollers, the number % of the extended domains, and the image ranks and bit value differences of the rollers are shown in Table 5.

Comparative Example 1

500 Parts by mass of a 1% solution of trifluoropropyltrimethoxysilane in isopropyl alcohol and 300 parts by mass of glass beads having an average particle diameter of 0.8 mm were added to 50 parts by mass of electroconductive tin oxide powder, and were dispersed therein with a paint shaker for 70 hours. SN-100P (manufactured by Ishihara Sangyo Kaisha, Ltd.) was used as the electroconductive tin oxide powder. After that, the dispersion liquid was filtered with a 500-mesh screen. Next, the solution was warmed in a warm bath at 100° C. while being stirred with a Nauta mixer. Thus, the alcohol was burnt off, and hence the solution was dried. After the drying, a silane coupling agent was applied to the surface of the dried product to provide surface-treated electroconductive tin oxide.

137 Parts by mass of polyester polyol (product name: KYOWAPOL 1000PA, hydroxyl value: 112 KOHmg/g, manufactured by Kyowa Hakko Kogyo Co., Ltd.) was dissolved in 463 parts by mass of methyl isobutyl ketone (MIBK) to provide a solution having a solid content of 16.0 mass %. 41.6 Parts by mass of the above-mentioned surface-treated electroconductive tin oxide powder and 200 parts by mass of glass beads each having a diameter of 0.8 mm were added to 200 parts by mass of the polyester polyol solution, and the mixture was loaded into a 450-milliliter mayonnaise bottle, followed by dispersion with a paint shaker for 6 hours. Further, 330 parts by mass of the dispersion liquid was mixed with 29.1 parts by mass of a block-type isocyanurate trimer of isophorone diisocyanate (IPDI) and 13.3 parts by mass of an isocyanurate trimer of hexamethylene diisocyanate (HDI). Then, the mixture was stirred with a ball mill for 1 hour. VESTANAT B1370 (manufactured by Degussa-Huls AG) was used as the IPDI, and DURANATE TPA-B80E (manufactured by Asahi Kasei Corporation) was used as the HDI. Finally, the solution was filtered with a 200-mesh screen so that its solid content became 39.6 mass %. Thus, a coating material for a surface layer was obtained.

The coating material was applied to the surface of the vulcanized rubber roller obtained in Example 1 by a dipping method.

Specifically, the coating material was applied to the surface at a lifting speed of 400 mm/min, and was air-dried for 30 minutes. After that, the axial direction of the roller was inverted, and the coating material was applied to the surface at a lifting speed of 400 mm/min again, followed by air drying for 30 minutes. Finally, the coating material was dried with an oven at 160° C. for 1 hour. At this time, the dried coating material had a thickness of 25

Comparative Example 2

A charging roller subjected to coating by the same method as that of Comparative Example 1 except that the surface-treated electroconductive tin oxide was not added was obtained. At this time, the coating of the roller had a thickness of 26

Comparative Example 3

A vulcanized rubber roller was obtained in the same manner as in Example 21 except that such a crown-shaped unvulcanized rubber roller that the diameter of each of its end portions was 8.6 mm and the diameter of its center portion was 8.7 mm was obtained by crosshead extrusion molding. The surface of the vulcanized rubber roller was polished to a depth of 50 μm with a rotary grinding stone. Thus, such a crown-shaped charging roller that the diameter of each of its end portions was 8.5 mm and the diameter of its center portion was 8.6 mm was obtained.

Comparative Example 4

A charging roller having such a crown shape that the diameter of each of its end portions was 8.5 mm and the diameter of its center portion was 8.6 mm was produced in the same manner as in Example 1 except that: the inner diameter of the die in the crosshead extrusion molding was changed to 8.6 mm; and the molding was performed while the feed speed of the mandrel was changed.

The surface resistance values of the charging rollers produced in Comparative Examples 1 to 4 described above, the inferior angle θ formed by the line segment P and the line segment Q in the extended domain of each of the rollers, the length of the "x" of the enveloping cuboid of the domain, the volume resistivity ratio m/d between the matrix and domains of each of the rollers, the number % of the extended domains, and the image ranks and bit value differences of the rollers are shown in Table 6.

TABLE 5

| Example | Surface resistance value of charging roller [Ω] | Inferior angle formed by line segment P and line segment Q [°] | Length of "x" [μm] | Volume resistivity ratio between matrix and domains m/d | Extended domains [number %] | Image rank | Bit value difference |
|---|---|---|---|---|---|---|---|
| 1 | 59 | 81 to 90 | 1.8 | $5.6 \times 10^6$ | 87 | A | 0.15 |
| 2 | $1.4 \times 10^{-1}$ | 81 to 90 | 1.5 | $5.7 \times 10^6$ | 83 | A | 0.09 |
| 3 | $1.7 \times 10^{-1}$ | 61 to 70 | 1.4 | $5.1 \times 10^6$ | 83 | A | 0.21 |
| 4 | $1.5 \times 10^{-1}$ | 51 to 60 | 1.5 | $5.2 \times 10^6$ | 85 | C | 0.97 |
| 5 | $2.0 \times 10^{-1}$ | 81 to 90 | 1.4 | $6.0 \times 10^6$ | 54 | A | 0.27 |
| 6 | $3.0 \times 10^{-1}$ | 61 to 70 | 1.3 | $5.8 \times 10^6$ | 52 | A | 0.38 |
| 7 | $2.0 \times 10^{-1}$ | 51 to 60 | 1.4 | $5.5 \times 10^6$ | 50 | C | 1.54 |
| 8 | 71 | 61 to 70 | 1.5 | $5.7 \times 10^6$ | 84 | A | 0.25 |

TABLE 5-continued

| Example | Surface resistance value of charging roller [Ω] | Inferior angle formed by line segment P and line segment Q [°] | Length of "x" [μm] | Volume resistivity ratio between matrix and domains m/d | Extended domains [number %] | Image rank | Bit value difference |
|---|---|---|---|---|---|---|---|
| 9 | 56 | 51 to 60 | 1.5 | $5.6 \times 10^6$ | 84 | C | 1.26 |
| 10 | 54 | 81 to 90 | 1.4 | $5.5 \times 10^6$ | 51 | A | 0.35 |
| 11 | 61 | 61 to 70 | 1.2 | $5.8 \times 10^6$ | 52 | A | 0.43 |
| 12 | 49 | 51 to 60 | 1.4 | $6.0 \times 10^6$ | 51 | C | 1.67 |
| 13 | $9.6 \times 10^2$ | 81 to 90 | 1.5 | $5.3 \times 10^6$ | 83 | A | 0.24 |
| 14 | $7.9 \times 10^2$ | 61 to 70 | 1.5 | $5.3 \times 10^6$ | 85 | A | 0.31 |
| 15 | $8.4 \times 10^2$ | 51 to 60 | 1.6 | $5.7 \times 10^6$ | 84 | C | 1.47 |
| 16 | $8.8 \times 10^2$ | 81 to 90 | 1.4 | $5.4 \times 10^6$ | 54 | A | 0.40 |
| 17 | $1.0 \times 10^3$ | 61 to 70 | 1.8 | $5.5 \times 10^6$ | 55 | A | 0.46 |
| 18 | $8.2 \times 10^2$ | 51 to 60 | 1.3 | $5.8 \times 10^6$ | 51 | C | 1.91 |
| 19 | 75 | 81 to 90 | 15.2 | $5.6 \times 10^6$ | 85 | A | 0.12 |
| 20 | 52 | 81 to 90 | 0.5 | $5.4 \times 10^6$ | 84 | A | 0.21 |
| 21 | 53 | 81 to 90 | 18.2 | $5.7 \times 10^6$ | 85 | B | 0.81 |
| 22 | 49 | 81 to 90 | 0.4 | $5.4 \times 10^6$ | 86 | B | 0.83 |
| 23 | 55 | 81 to 90 | 1.5 | $1.0 \times 10^3$ | 84 | A | 0.22 |
| 24 | 86 | 81 to 90 | 1.4 | $8.9 \times 10^2$ | 86 | B | 0.52 |
| 25 | 64 | 81 to 90 | 1.1 | $5.8 \times 10^7$ | 84 | A | 0.15 |
| 26 | 52 | 81 to 90 | 2.1 | $1.2 \times 10^{12}$ | 85 | A | 0.14 |
| 27 | 50 | 81 to 90 | 1.0 | $5.7 \times 10^6$ | 83 | A | 0.16 |
| 28 | 53 | 81 to 90 | 1.4 | $5.5 \times 10^6$ | 86 | A | 0.15 |
| 29 | 71 | 81 to 90 | 1.6 | $5.6 \times 10^6$ | 85 | A | 0.14 |
| 30 | 60 | 81 to 90 | 1.6 | $5.3 \times 10^6$ | 84 | A | 0.17 |
| 31 | 54 | 81 to 90 | 1.4 | $5.4 \times 10^6$ | 85 | A | 0.16 |
| 32 | 66 | 81 to 90 | 1.6 | $5.3 \times 10^6$ | 83 | A | 0.16 |
| 33 | 73 | 81 to 90 | 1.6 | $5.5 \times 10^6$ | 81 | A | 0.14 |
| 34 | 76 | 81 to 90 | 1.6 | $5.2 \times 10^6$ | 82 | A | 0.15 |
| 35 | 83 | 81 to 90 | 1.5 | $5.3 \times 10^6$ | 82 | A | 0.14 |
| 36 | 41 | 81 to 90 | 1.6 | $2.1 \times 10^6$ | 83 | A | 0.15 |
| 37 | 43 | 81 to 90 | 1.5 | $6.2 \times 10^6$ | 85 | A | 0.15 |
| 38 | 37 | 51 to 60 | 1.4 | $5.1 \times 10^6$ | 86 | C | 1.28 |
| 39 | $1.3 \times 10^2$ | 81 to 90 | 2.3 | $3.5 \times 10^9$ | 84 | A | 0.13 |
| 40 | $1.1 \times 10^2$ | 81 to 90 | 8.9 | $1.1 \times 10^{13}$ | 85 | A | 0.11 |
| 41 | $1.4 \times 10^2$ | 81 to 90 | 0.5 | $4.2 \times 10^9$ | 83 | A | 0.22 |
| 42 | 46 | 81 to 90 | 1.4 | $3.7 \times 10^4$ | 85 | A | 0.21 |

TABLE 6

| Comparative Example | Surface resistance value of charging roller [Ω] | Inferior angle θ formed by line segment P and line segment Q [°] | Length of "x" [μm] | Volume resistivity ratio between matrix and domains m/d | Extended domains [number %] | Image rank | Bit value difference |
|---|---|---|---|---|---|---|---|
| 1 | $2.9 \times 10^3$ | — | — | $5.5 \times 10^6$ | — | D | 3.57 |
| 2 | $6.3 \times 10^3$ | — | — | $5.3 \times 10^6$ | — | D | 5.44 |
| 3 | $5.2 \times 10^3$ | 61 to 70 | 1.1 | $6.1 \times 10^6$ | 52 | D | 4.85 |
| 4 | 54 | 81 to 90 | 1.4 | $5.1 \times 10^6$ | 46 | D | 4.31 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-186694, filed Nov. 9, 2020, and Japanese Patent Application No. 2021-150875, filed Sep. 16, 2021, which are hereby incorporated by reference herein in their entirety.

What is claimed is:

1. A charging roller comprising:

an electroconductive mandrel; and an electroconductive layer as a surface layer, the electroconductive layer including a matrix containing a cross-linked product of a first rubber and domains dispersed in the matrix, each of the domains containing a cross-linked product of a second rubber and an electroconductive particle, and each of the domains having a volume resistivity lower than a volume resistivity of the matrix, wherein when sampling a cubic sample of the electroconductive layer having a side of 20.0 um from a region from an outer surface of the electroconductive layer to a depth of 20.0 um, 50 number% or more of all the domains in the cubic sample satisfy a condition:

assuming that a domain to be judged in the cubic sample is enveloped by an enveloping cuboid, the enveloping cuboid having two surfaces each of which is perpendicular to a line segment L, the line segment L passing through at least one arbitrary point in the domain to be judged and being perpendicular to a surface of the electroconductive mandrel, "x" is longer than "y" and "z", where "x" is a length of the enveloping cuboid in an X-axis direction, "y" is a length thereof in a Y-axis direction, and "z" is a length thereof in a Z-axis direction, and a line segment S that is perpendicular to the line segment L and is parallel to an X-axis is able to be drawn.

2. The charging roller according to claim 1, wherein when a longest line segment out of line segments each connecting a portion of a first YZ surface of the enveloping cuboid in contact with the domain and a portion of a second YZ surface thereof in contact with the domain is defined as a line segment P, and when a line segment Q having a same starting point as a starting point of the line segment P in the first or second YZ surface and being perpendicular to the surface of the electroconductive mandrel is drawn, and when an inferior angle formed by the line segment P and the line segment Q is defined as an inferior angle 0, a mode value of the inferior angle 0 of each of all the domains in the cubic sample is 60° to 90°.

3. The charging roller according to claim 1, wherein an average value of the length "x" of the enveloping cuboid which envelopes the respective domains satisfying the condition is 0.5 μm to 15.0 μm.

4. The charging roller according to claim 1, wherein a surface resistance value measured on an outer surface of the charging roller is $1.0\times10^{-1}$ Ω to $1.0\times10^{3}$ Ω.

5. The charging roller according to claim 1, wherein the volume resistivity "d" of each of the domains and the volume resistivity "m" of the matrix satisfy a relationship of $m/d\geq1.0\times10^{3}$.

6. A process cartridge detachably attachable to a main body of an electrophotographic image forming apparatus, the process cartridge comprising:

an electrophotographic photosensitive member; and a charging roller arranged so as to be capable of charging the electrophotographic photosensitive member, the charging roller comprising:

an electroconductive mandrel; and an electroconductive layer as a surface layer, the electroconductive layer including a matrix containing a cross-linked product of a first rubber and domains dispersed in the matrix, each of the domains containing a cross-linked product of a second rubber and an electroconductive particle, and each of the domains having a volume resistivity lower than a volume resistivity of the matrix, wherein when sampling a cubic sample of the electroconductive layer having a side of 20.0 um from a region from an outer surface of the electroconductive layer to a depth of 20.0 pm, 50 number% or more of all the domains in the cubic sample satisfy a condition:

assuming that a domain to be judged in the cubic sample is enveloped by an enveloping cuboid, the enveloping cuboid having two surfaces each of which is perpendicular to a line segment L, the line segment L passing through at least one arbitrary point in the domain to be judged and being perpendicular to a surface of the electroconductive mandrel, "x" is longer than "y" and "z", where "x" is a length of the enveloping cuboid in an X-axis direction, "y" is a length thereof in a Y-axis direction, and "z" is a length thereof in a Z-axis direction, and a line segment S that is perpendicular to the line segment L and is parallel to an X-axis is able to be drawn.

7. An electrophotographic image forming apparatus comprising:

an electrophotographic photosensitive member; and a charging roller arranged so as to be capable of charging the electrophotographic photosensitive member, the charging roller comprising:

an electroconductive mandrel; and an electroconductive layer as a surface layer, the electroconductive layer including a matrix containing a cross-linked product of a first rubber and domains dispersed in the matrix, each of the domains containing a cross-linked product of a second rubber and an electroconductive particle, and each of the domains having a volume resistivity lower than a volume resistivity of the matrix, wherein when sampling a cubic sample of the electroconductive layer having a side of 20.0 μm from a region from an outer surface of the electroconductive layer to a depth of 20.0 pm, 50 number% or more of all the domains in the cubic sample satisfy a condition:

assuming that a domain to be judged in the cubic sample is enveloped by an enveloping cuboid, the enveloping cuboid having two surfaces each of which is perpendicular to a line segment L, the line segment L passing through at least one arbitrary point in the domain to be judged and being perpendicular to a surface of the electroconductive mandrel, "x" is longer than "y" and "z", where "x" is a length of the enveloping cuboid in an X-axis direction, "y" is a length thereof in a Y-axis direction, and "z" is a length thereof in a Z-axis direction, and a line segment S that is perpendicular to the line segment L and is parallel to an X-axis is able to be drawn.

* * * * *